US009951600B2

(12) United States Patent
Hannegan et al.

(10) Patent No.: US 9,951,600 B2
(45) **Date of Patent: *Apr. 24, 2018**

(54) MANAGED PRESSURE CEMENTING

(71) Applicant: Weatherford Technology Holdings, LLC, Houston, TX (US)

(72) Inventors: Don M. Hannegan, Fort Smith, AR (US); Cesar Pena, Houston, TX (US); David Pavel, Kingwood, TX (US); Michael Brian Grayson, Sugar Land, TX (US); Said Boutalbi, Houston, TX (US); Todd Douglas Cooper, The Woodlands, TX (US); Timothy P. Dunn, Fulshear, TX (US); Frank Zamora, Jr., San Antonio, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/011,750

(22) Filed: Feb. 1, 2016

(65) Prior Publication Data

US 2016/0145995 A1 May 26, 2016

Related U.S. Application Data

(63) Continuation of application No. 13/676,660, filed on Nov. 14, 2012, now Pat. No. 9,249,646.

(Continued)

(51) Int. Cl.
*E21B 47/00* (2012.01)
*E21B 33/13* (2006.01)

(Continued)

(52) U.S. Cl.
CPC ..... *E21B 47/0005* (2013.01); *E21B 33/13* (2013.01); *E21B 33/14* (2013.01);

(Continued)

(58) Field of Classification Search
CPC .. E21B 47/0001; E21B 47/0005; E21B 33/13; E21B 33/14; E21B 33/143; E21B 33/16
See application file for complete search history.

(56) References Cited

U.S. PATENT DOCUMENTS 1,563,520 A * 12/1925 Owen ..... E21B 33/14 166/193
2,743,779 A * 5/1956 Brown ..... E21B 33/138 166/290

(Continued)

FOREIGN PATENT DOCUMENTS

WO 2010/027366 A1 3/2010
WO 2012/008844 A1 1/2012

(Continued)

OTHER PUBLICATIONS

EPO Partial European Search Report dated May 4, 2016, for EPO Patent Application No. 12192976.4.

(Continued)

*Primary Examiner* — Matthew R Buck
(74) *Attorney, Agent, or Firm* — Patterson & Sheridan, L.L.P.

(57) ABSTRACT

A method of cementing a tubular string in a wellbore includes: deploying the tubular string into the wellbore; pumping cement slurry into the tubular string; launching a cementing plug after pumping the cement slurry; propelling the cementing plug through the tubular string, thereby pumping the cement slurry through the tubular string and into an annulus formed between the tubular string and the wellbore; and controlling flow of fluid displaced from the wellbore by the cement slurry to control pressure of the annulus.

20 Claims, 22 Drawing Sheets

Related U.S. Application Data

(60) Provisional application No. 61/560,500, filed on Nov. 16, 2011.

(51) Int. Cl.
*E21B 33/14* (2006.01)
*E21B 33/16* (2006.01)

(52) U.S. Cl.
CPC ..... *E21B 33/143* (2013.01); *E21B 33/16* (2013.01); *E21B 47/0001* (2013.01)

(56) References Cited

U.S. PATENT DOCUMENTS 3,159,219 A * 12/1964 Scott ..... E21B 17/14 166/156
3,561,531 A 2/1971 Miller
3,638,730 A * 2/1972 Smith ..... E21B 33/16 166/153
4,093,028 A * 6/1978 Brandon ..... B06B 3/00 166/281
4,512,401 A * 4/1985 Bodine ..... E21B 43/003 166/177.1
4,548,271 A * 10/1985 Keller ..... E21B 33/16 166/285
4,571,993 A * 2/1986 St. Onge ..... E21B 21/08 166/250.14
4,641,708 A 2/1987 Wightman
4,813,495 A 3/1989 Leach
4,854,383 A 8/1989 Arnold et al.
5,103,908 A 4/1992 Allen
5,226,478 A 7/1993 Henderson, Jr. et al.
5,289,877 A 3/1994 Naegele et al.
5,323,858 A * 6/1994 Jones ..... E21B 33/16 166/153
5,484,020 A 1/1996 Cowan
5,829,523 A * 11/1998 North ..... E21B 33/16 166/155
5,950,724 A 9/1999 Giebeler
6,053,245 A * 4/2000 Haberman ..... E21B 47/0005 166/250.14
6,056,053 A 5/2000 Giroux et al.
6,138,774 A 10/2000 Bourgoyne, Jr. et al.
6,230,824 B1 5/2001 Peterman et al.
6,360,822 B1 3/2002 Robertson
6,401,814 B1 * 6/2002 Owens ..... E21B 47/091 166/250.14
6,429,784 B1 * 8/2002 Beique ..... E21B 17/14 166/250.07
6,554,068 B1 * 4/2003 Chatterji ..... E21B 33/16 166/192
6,672,384 B2 1/2004 Pedersen et al.
6,693,554 B2 * 2/2004 Beique ..... E21B 17/14 166/250.01
6,819,121 B1 * 11/2004 Hager, III ..... G01N 33/383 324/664
6,847,034 B2 * 1/2005 Shah ..... E21B 23/08 166/250.01
7,013,971 B2 * 3/2006 Griffith ..... E21B 33/14 166/250.14
7,044,237 B2 5/2006 Leuchtenberg
7,055,611 B2 6/2006 Pedersen et al.
7,066,249 B2 6/2006 Simson
7,073,591 B2 7/2006 Massie et al.
7,159,669 B2 1/2007 Bourgoyne et al.
7,252,147 B2 * 8/2007 Badalamenti ..... E21B 33/14 166/177.4
7,252,152 B2 8/2007 LoGiudice et al.
7,270,183 B2 * 9/2007 Bour ..... C04B 28/02 106/672
7,303,008 B2 * 12/2007 Badalamenti ..... E21B 47/0005 166/177.4
7,350,597 B2 * 4/2008 Reitsma ..... E21B 21/08 166/265
7,549,475 B2 6/2009 Tjorswaag et al.
7,963,323 B2 * 6/2011 Bailey ..... E21B 17/028 166/250.01
8,347,982 B2 1/2013 Hannegan et al.
8,636,063 B2 * 1/2014 Ravi ..... E21B 33/14 166/253.1
9,249,646 B2 * 2/2016 Hannegan ..... E21B 47/0005
9,279,299 B2 * 3/2016 Lovorn ..... E21B 21/08
2004/0221997 A1 * 11/2004 Giroux ..... E21B 4/02 166/380
2005/0006106 A1 1/2005 Hirth et al.
2007/0068703 A1 * 3/2007 Tessari ..... E21B 7/20 175/57
2007/0227774 A1 * 10/2007 Reitsma ..... E21B 21/08 175/25
2007/0261850 A1 * 11/2007 Giroux ..... E21B 7/20 166/291
2008/0060846 A1 3/2008 Belcher et al.
2008/0067810 A1 3/2008 Peer et al.
2008/0135248 A1 * 6/2008 Talley ..... E21B 34/14 166/285
2008/0272931 A1 * 11/2008 Auzerais ..... E21B 33/16 340/854.7
2009/0236144 A1 9/2009 Todd et al.
2010/0288507 A1 * 11/2010 Duhe ..... E21B 21/08 166/370
2011/0155368 A1 * 6/2011 El-Khazindar ..... E21B 47/00 166/250.01
2011/0253445 A1 10/2011 Hannegan et al.
2012/0126993 A1 5/2012 Samson et al.
2012/0247831 A1 * 10/2012 Kaasa ..... E21B 21/08 175/25

FOREIGN PATENT DOCUMENTS

WO 2012/065123 A2 5/2012
WO 2012/140445 A2 10/2012

OTHER PUBLICATIONS

Bjorkevoll et al.—"Innovative Design, Operational Modelling and Lessons Learned for Pressure Management During Underbalanced Cementing with Choked Return Flow," (OMC-2005-075) paper presented at the Offshore Mediterranean Conference and Exhibition in Ravenna, Italy, Mar. 16-18, 2005, 14 pages.
Weatherford; WellMaster All-In-One Deepwater System; date unknown, 1 page.
Watters; White Paper; Analysis of Current Cementing Procedures Employed in the US Outer Continental Shelf: Optimized Methods and Additional R&D Required; date unknown; 5 total pages.
At Balance With Smith; EmPower Automated MPD Technology brochure, date unknown, 8 total pages.
Atkinson, et al.; A New Horizon in Multiphase Flow Measurement; Oilfied Review; Winter 2004/2005; 12 total pages.
Eck-Olsen, et al.; SPE/IADC 92568; Managing Pressures During Underbalanced Cementing by Choking the Return Flow; Innovative Design and Operational Modeling as well as Operational Lessons; 2005; 6 total pages.
Weatherford; Liner Systems; Top-Drive Cementing Head (TDH) dated 2006-2010; 3 total pages.
Hager III, et al.; Monitoring of Hydration Processes in Cement Materials by Broadband Time-Domain-Reflectometry Dielectric Spectroscopy; 2007; 11 total pages.
Bjorkevoll, et al.; SPE 115118; Utilize Manage Pressure Drilling Equipment and Technique to Cement a Severely Depleted HPHT Reservoir in the North Sea; dated 2008; 11 total pages.
Hinton; IADC/SPE 122201; A New Chapter in MPD: Subsea Pumping; dated 2009; 6 total pages.
Beltran, et al.; SPE/IADC 130313; Managed Pressure Drilling Brings Added Value to Production Casings Cementing Dperations Increasing Success Rates and Quality in HPHT Fractured Narrow Window Wells; dated 2010; 8 total pages.

(56) References Cited

OTHER PUBLICATIONS

Fredericks, et al.; SPE/IADC 130319; Experience and Results with a New Automated MPD System While Drilling and Cementing Liner in an Onshore Depleted Gas Field; dated 2010; 12 total pages.
Montilva, et al.; IADC/SPE 128923; New Automated Control System Manages Pressure and Return Flow While Drilling and Cementing Casing in Depleted Onshore Field; dated 2010; 11 total pages.
Weatherford; Microflux Control System; dated 2010; 12 total pages.
Managed Pressure & Underbalanced Drilling Discussion Forum—Daily Summary; dated May 5, 2011; 2 total pages.
Kemche, et al.; IADC/SPE 143093; Managed Pressure Drilling Enables Drilling Beyond the Conventional Limit on an HP/HT Deepwater Well in the Mediterranean Sea; dated 2011; 17 total pages.
Kroken, et al.; AADE-12-FTCE-18; A New Waste Management Method Utilizing a Compact Lightweight Solids Control System Reducing Waste Volume and Improving Filtration; dated 2012; 9 total pages.
Australian Patent Examination Report for Application No. 2012254933; dated Apr. 23, 2014; 6 total pages.
EPO Partial European Search Report dated Aug. 22, 2016, for EPO Patent Application No. 12192976A.
EPO Office Action dated Dec. 20, 2017, for European Patent Application No. 12192976.4.

* cited by examiner

MANAGED PRESSURE CEMENTING

BACKGROUND OF THE INVENTION

Field of the Invention

Embodiments of the present invention generally relate to managed pressure cementing.

Description of the Related Art

In wellbore construction and completion operations, a wellbore is formed to access hydrocarbon-bearing formations (e.g., crude oil and/or natural gas) by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is hung from the wellhead. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Once the initial or surface casing has been cemented, the wellbore may be extended and another string of casing or liner may be cemented into the wellbore. This process may be repeated until the wellbore intersects the formation. Once the formation has been produced and depleted, cement plugs may be used to abandon the wellbore. If the wellbore is exploratory, tests may be performed and then the wellbore abandoned.

Not all wells that are drilled and casing strings cemented in place during the well operation are problematic. Conversely, primary cementing of problematic wells has historically been inefficient to unobtainable by manipulation of the traditional variables. What can be recorded today to effectively measure the success or failure of a primary cement job is not adequate for cementing problematic wells. Understanding the objectives of a primary cement job, being able to execute the primary cement job and adequately interpreting the results have ultimately been the criteria of a success or a failure. Whether success is a leak-off test, open-hole kick-off plug, isolation of a hydrocarbon bearing zone of interest, or a fresh water zone that must be hydraulically or mechanically isolated and protected, the tools and methods that operators and service companies employ today that can be controlled and monitored are not always enough to provide the expected nor the desired results.

SUMMARY OF THE INVENTION

Embodiments of the present invention generally relate to managed pressure cementing. In one embodiment, a method of cementing a tubular string in a wellbore includes: deploying the tubular string into the wellbore; pumping cement slurry into the tubular string; launching a cementing plug after pumping the cement slurry; propelling the cementing plug through the tubular string, thereby pumping the cement slurry through the tubular string and into an annulus formed between the tubular string and the wellbore; and controlling flow of fluid displaced from the wellbore by the cement slurry to control pressure of the annulus.

In another embodiment, a method of cementing a tubular string in a wellbore includes: deploying the tubular string into the wellbore, the tubular string including one or more cement sensors; pumping cement slurry into the tubular string; launching a cementing plug after pumping the cement slurry; propelling the cementing plug through the tubular string, thereby pumping the cement slurry through the tubular string and into an annulus formed between the tubular string and the wellbore; and analyzing data from the cement sensors during curing of the cement slurry.

In another embodiment, a method of cementing a tubular string in a subsea wellbore includes: deploying the tubular string into the subsea wellbore; pumping cement slurry into the tubular string; launching a cementing plug after pumping the cement slurry; propelling the cementing plug through the tubular string using a chase (aka displacement) fluid, thereby pumping the cement slurry through the tubular string and into an annulus formed between the tubular string and the wellbore; measuring a flow rate of the chase fluid; and measuring a flow rate of fluid displaced from the wellbore by diverting the displaced fluid from a bore of a pressure control assembly connected to a subsea wellhead of the subsea wellbore through a subsea flow meter of the pressure control assembly.

In another embodiment, a method for drilling a wellbore includes drilling the wellbore by injecting drilling fluid into a top of a drill string disposed in the wellbore at a first flow rate and rotating a drill bit. The drilling fluid exits the drill bit and carries cuttings from the drill bit. The cuttings and drilling fluid (returns) flow from the drill bit through an annulus defined between the tubular string and the wellbore. A seal of a rotating control device is engaged with the drill string and diverts the returns into an outlet of the rotating control device. The method further includes, while drilling the wellbore: choking the flow of returns such that a bottomhole pressure corresponds to a target pressure, wherein the target pressure is greater than or equal to a pore pressure and less than a fracture pressure of an exposed formation adjacent to the wellbore; increasing the returns choking such that the bottomhole pressure corresponds to a pressure expected during cementing of the exposed formation; and while the returns choking is increased: measuring the first flow rate; measuring a flow rate of the returns; and comparing the returns flow rate to the first flow rate to ensure integrity of the exposed formation.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
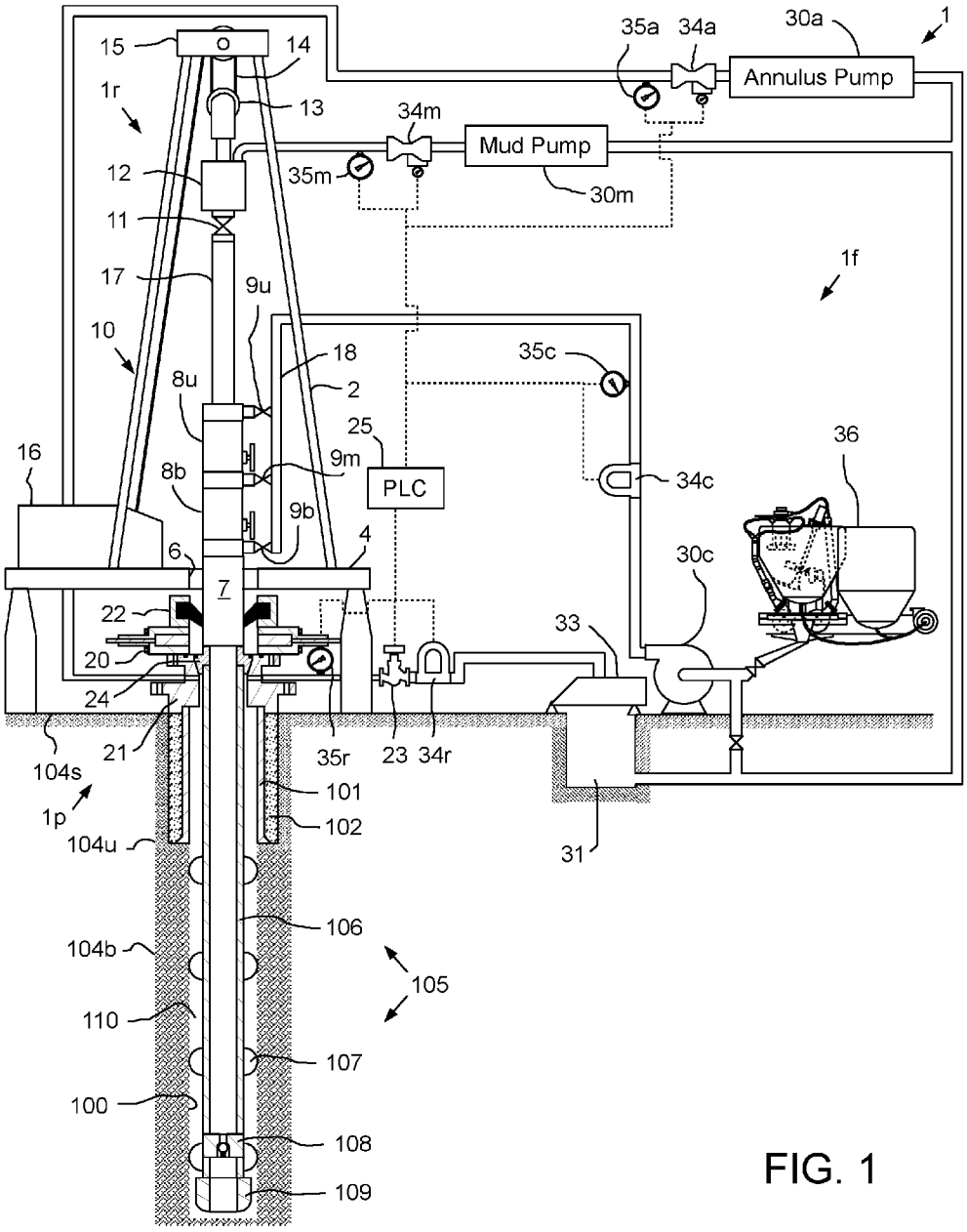
FIG. 1 illustrates a terrestrial drilling system in a casing cementing mode, according to one embodiment of the present invention.

FIG. 1 illustrates a terrestrial drilling system 1 in a casing cementing mode, according to one embodiment of the present invention. The drilling system 1 may include a drilling rig 1*r*, a fluid handling system 1*f*, and a pressure control assembly (PCA) 1*p*. The drilling rig 1*r* may include a derrick 2 having a rig floor 4 at its lower end having an opening 6 through which a casing adapter 7 extends downwardly into the PCA 1*p*. The PCA 1*p* may be connected to a wellhead 21. The wellhead 21 may be mounted on an outer casing string 101 which has been deployed into a wellbore 100 drilled from a surface 104*s* of the earth and cemented 102 into the wellbore. The casing adapter 7 may include a seal head (not shown) for engaging an inner casing string 105 which has been deployed into the wellbore 100 and is ready to be cemented into place. The casing adapter 7 may also be connected to a cementing head 10. The cementing head 10 may also be connected to a Kelly valve 11 via spool 17. The Kelly valve 11 may be connected to a quill of a top drive 12. The top drive 12 may include a motor for rotating a drill string. The top drive motor may be electric or hydraulic. A housing of the top drive 12 may be coupled to a rail (not shown) of the derrick 2 for preventing rotation of the top drive housing during rotation of the drill string and allowing for vertical movement of the top drive with a traveling block 13. A housing of the top drive 12 may be suspended from the derrick 2 by the traveling block 13. The traveling block 13 may be supported by wire rope 14 connected at its upper end to a crown block 15. The wire rope 14 may be woven through sheaves of the blocks 13, 15 and extend to drawworks 16 for reeling thereof, thereby raising or lowering the traveling block 13 relative to the derrick 2.

Alternatively, the wellbore may be subsea having a wellhead located adjacent to the waterline and the drilling rig may be a located on a platform adjacent the wellhead. Alternatively, a Kelly and rotary table (not shown) may be used instead of the top drive.

Figure 2A:
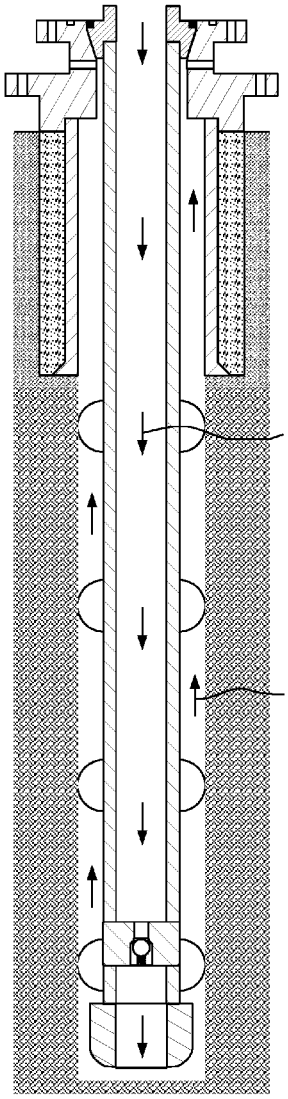
FIGS. 2A-2G illustrate a casing cementing operation performed using the drilling system.
Figure 2B:
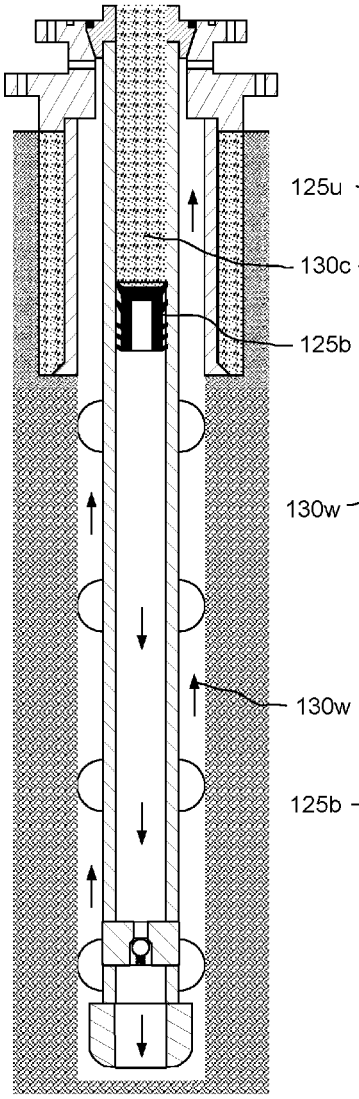
Figure 2C:
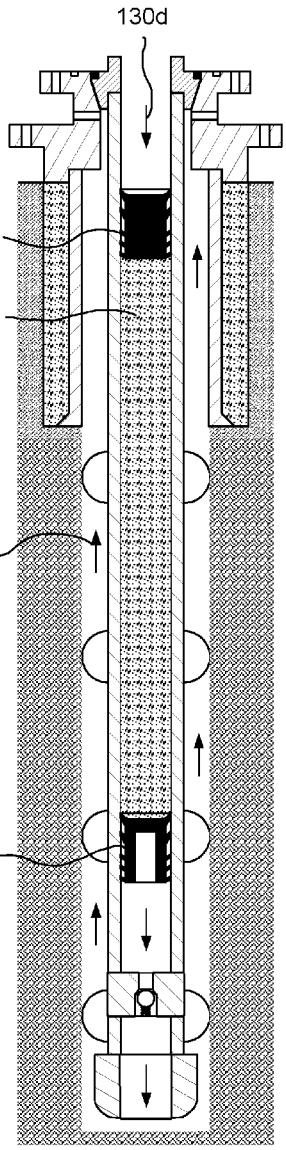
Figures 2D, 2E, 2F:
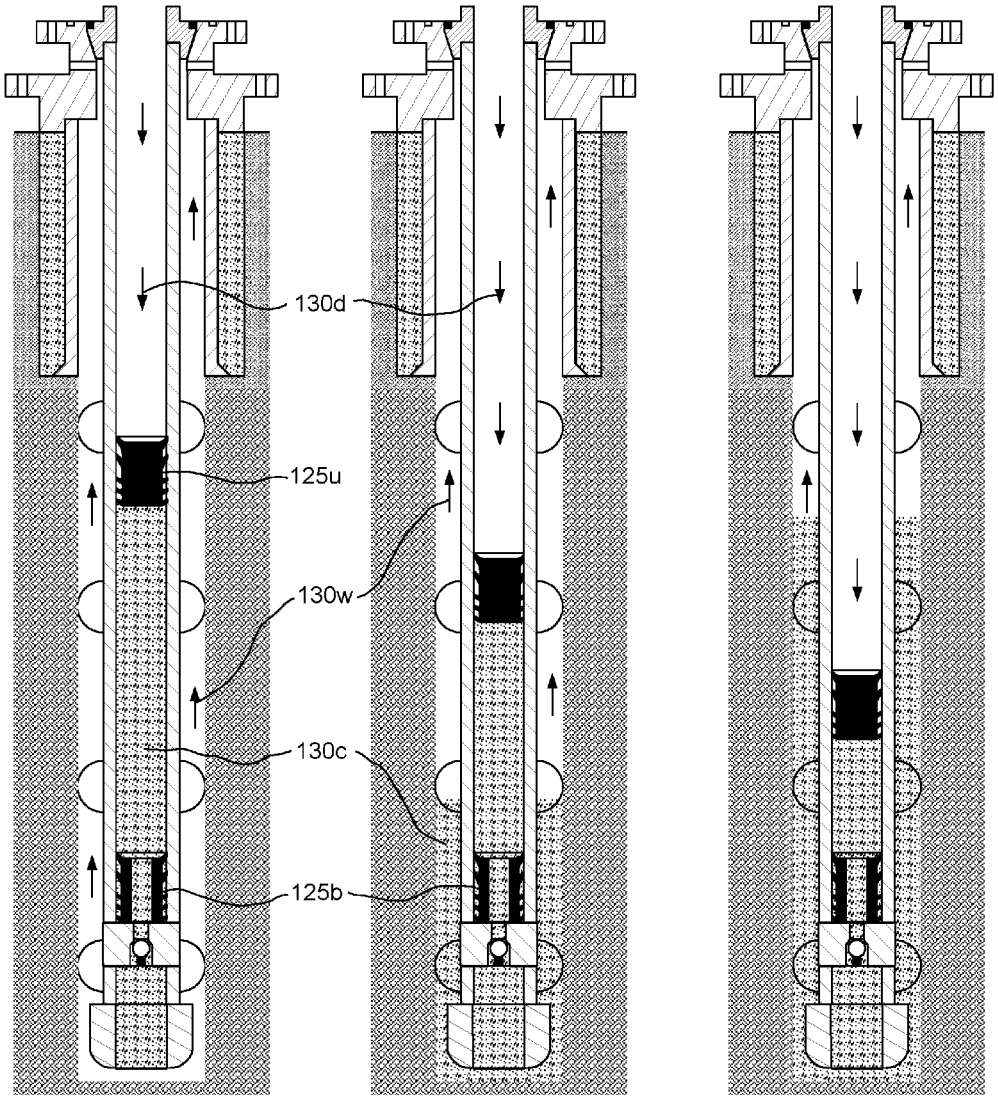
Figure 2G:
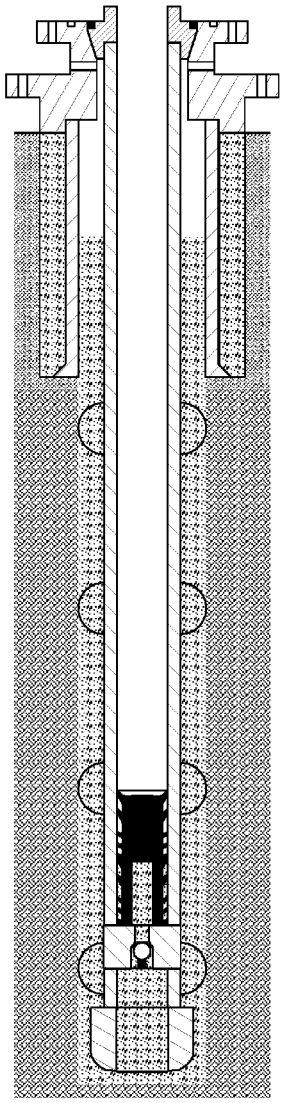

The cementing head 10 may include one or more plug launchers 8*u,b*, and a manifold 18. The cementing manifold 18 may include a trunk and one or more branches, such as three. Each branch may include a shutoff valve 9*u,m,b*, for providing selective fluid communication between the manifold trunk and the launchers 8*u,b*. Each launcher 8*u,b* may include a canister for housing a respective cementing plug, such as wiper 125*u,b* (FIGS. 2B and 2C), and retainer valve or latch operable to selectively retain the respective wiper in the launcher. A lower branch having the valve 9*b* may connect the manifold trunk directly to the casing adapter 7, thereby bypassing the launchers 8*u,b*. A mid branch having the valve 9*m* may connect the trunk between the launchers 8*u,b* for deploying the a bottom wiper 125*b*. An upper branch having the valve 9*u* may connect the trunk above an upper launcher 8*u* for deploying a top wiper 125*u*.

The PCA 1*p* may include a blow out preventer (BOP) 20, a rotating control device (RCD) 22, and a variable choke valve 23. A housing of the BOP 20 may be connected to the wellhead 21, such as by a flanged connection. The BOP housing may also be connected to a housing of the RCD 22, such as by a flanged connection. The RCD 22 may include a stripper seal and the housing. The stripper seal may be supported for rotation relative to the housing by bearings. The stripper seal-housing interface may be isolated by seals. The stripper seal may form an interference fit with an outer surface of the casing adapter 7 and be directional for augmentation by wellbore pressure. Alternatively, the stripper seal may be an inflatable bladder or a lubricated packer assembly. Alternatively, a packer or BOP may be used instead of the RCD.

The choke 23 may be connected to an outlet port 210 (FIG. 3B) of the wellhead 21. The choke 23 may be fortified to operate in an environment where return fluid may include solids, such as cuttings. The choke 23 may include a hydraulic actuator operated by a programmable logic controller (PLC) 25 via a hydraulic power unit (HPU) (not shown) to maintain backpressure (FIG. 3A) in the wellhead 21. Alternatively, the choke actuator may be electrical or pneumatic.

The outer casing string 101 may extend to a depth adjacent a bottom of an upper formation 104*u* and the inner casing string 105 may extend into a portion of the wellbore 100 traversing a lower formation 104*b*. The upper formation 104*u* may be non-productive and the lower formation 104*b* may be a hydrocarbon-bearing reservoir. Alternatively, the lower formation 104*b* may be environmentally sensitive, such as an aquifer, or unstable. The inner casing string 105 may include a plurality of casing joints 106 connected together, such as by threaded connections, one or more centralizers 107 spaced along the casing joints at regular intervals, a float collar 108, a guide shoe 109, and a casing hanger 24. Each casing joint 106 may be made from a metal or alloy, such as steel or stainless steel. The centralizers 107 may be fixed or sprung. The centralizers 107 may engage an inner surface of the outer casing 101 and/or wellbore 100. The centralizers 107 may operate to center the inner casing 105 in the wellbore 100.

The shoe 109 may be disposed at the lower end of the casing string 105 and have a bore formed therethrough. The shoe 109 may be convex for guiding the casing string 105 toward the center of the wellbore 100. The shoe 109 may minimize problems associated with hitting rock ledges or washouts in the wellbore 100 as the casing string 105 is lowered into the wellbore. An outer portion of the shoe 109 may be made from the casing material, discussed above. An inner portion of the shoe 109 may be made of a drillable material, such as cement, cast iron, non-ferrous metal or alloy, or polymer, so that the inner portion may be drilled through if the wellbore 100 is to be further drilled. The float collar 108 may include a check valve for selectively sealing the shoe bore. The check valve may be operable to allow fluid flow from the casing bore into the wellbore 100 and prevent reverse flow from the wellbore into the casing bore.

The fluid system if may include one or pumps 30*a,m,c*, a drilling fluid reservoir, such as a pit 31 or tank, a degassing spool (not shown, see degassing spool 230 in FIG. 7A), a solids separator, such as a shale shaker 33, one or more flow meters 34*a,m,c,r* and one or more pressure sensors 35*a,m,c,r*. Each pressure sensor 35*a,m,c,r* may be in data communication with the PLC 25. The pressure sensor 35*r* may be connected between the choke 23 and the outlet port 210 and may be operable to monitor wellhead pressure. The pressure sensor 35*a* may be connected between an annulus pump 30*a* and an inlet port 21*i* of the wellhead 21 and may be operable to monitor a discharge pressure of the annulus pump. The pressure sensor 35*m* may be connected between a mud pump 30*m* and a standpipe (not shown) connected to an inlet of the top drive 12 and may be operable to monitor standpipe pressure. The pressure sensor 35*c* may be connected between a cement pump 30*c* and the cementing manifold 18 and may be operable to monitor manifold pressure.

The returns 34*r* and cement 34*c* flow meters may each be a mass flow meter, such as a Coriolis flow meter, and may each be in data communication with the PLC 25. The cement flow meter 35*c* may be connected between the cement pump 30*c* and the cementing manifold 18 and may be operable to monitor a flow rate of the cement pump. The returns flow meter 34*r* may be connected between the choke 23 and the shale shaker 33 and may be operable to monitor a flow rate of return fluid. The supply 34*m* and annulus 34*a* flow meters may each be a volumetric flow meter, such as a Venturi flow meter and may each be in data communication with the PLC 25. The annulus flow meter 34*a* may be connected between the annulus pump 30*a* and the inlet port 21*i* and may be operable to monitor a flow rate of the annulus pump. The PLC 25 may receive a density measurement of indicator fluid 130*i* (FIG. 3E) from an indicator fluid blender (not shown) to determine a mass flow rate of the indicator fluid from the volumetric measurement of the supply flow meter 34*d*. The supply flow meter 35*m* may be connected between a mud pump 30*m* and the standpipe and may be operable to monitor a flow rate of the mud pump. The PLC 25 may receive a density measurement of drilling fluid 130*m* (FIG. 2A) from a mud blender (not shown) to determine a mass flow rate of the drilling fluid from the volumetric measurement of the supply flow meter 34*d*.

Alternatively, a stroke counter (not shown) may be used to monitor a flow rate of each pump 30*a,m,c* instead of the respective flow meters. Alternatively, the annulus 34*a* and/or supply 34*m* flow meters may be mass flow meters. Alternatively, the cement flow meter 34*c* may be a volumetric flow meter.

In the drilling mode (not shown, see FIG. 7A), such as for extending the wellbore 100 from a shoe of casing 101 to a depth for deploying the casing 105, the mud pump 30*m* may pump the drilling fluid 130*m* from the pit 31, through the standpipe and a Kelly hose to the top drive 12. The drilling fluid 130*m* may include a base liquid. The base liquid may be refined oil, water, brine, or a water/oil emulsion. The drilling fluid 130*m* may further include solids dissolved or suspended in the base liquid, such as organophilic clay, lignite, and/or asphalt, thereby forming a mud. Alternatively, the drilling fluid 130*m* may further include a gas, such as diatomic nitrogen mixed with the base liquid, thereby forming a two-phase mixture. If the drilling fluid 130*m* is two-phase, the drilling system 1 may further include a nitrogen production unit (not shown) operable to produce commercially pure nitrogen from air.

The drilling fluid 130*m* may flow from the standpipe and into a drill string (not shown, see drill string 207 in FIGS. 7A-7C) via the top drive 12. The drilling fluid 130*m* may be pumped down through the drill string and exit a drill bit, where the fluid may circulate the cuttings away from the bit and return the cuttings up an annulus formed between an inner surface of the casing 101 or wellbore 100 and an outer surface of the drill string. The returns (drilling fluid plus cuttings) may flow up the annulus to the wellhead 21 and be diverted by the RCD 22 into the wellhead outlet 21*o*. The returns may continue through the choke 23 and the flow meter 34*r*. The returns may then flow into the shale shaker 33 and be processed thereby to remove the cuttings, thereby completing a cycle. As the drilling fluid 130*m* and returns circulate, the drill string may be rotated by the top drive 12 and lowered by the traveling block 13, thereby extending the wellbore 100 into the lower formation 104*b*.

During drilling, the PLC 25 may perform a mass balance between the drilling fluid 130*m* and the returns to monitor for formation fluid entering the annulus or drilling fluid entering the formation using the flow meters 34*m,r*. The PLC 25 may then compare the measurements for detecting formation fluid ingress or drilling fluid egress may take remedial action by adjusting the choke 23 (some ingress may be tolerated for underbalanced drilling).

Once the wellbore 100 has been drilled to a depth sufficient to accommodate the outer casing 105, the drill string may be retrieved to surface 104*s*. The outer casing 105 may be assembled and deployed into the wellbore 100. Alternatively, the casing 105 may be drilled into the wellbore instead of using the drill string. Once the casing 105 has been deployed into the wellbore 100 and the casing hanger 24 landed into the wellhead 21, the casing adapter 7 may be engaged with the casing hanger 24. The cementing head 10 may be connected to the casing adapter and the top drive 12. A cement mixer, such as a recirculating mixer 36, cement pump 30*c*, and cementing conduit may be connected to the manifold trunk.

FIGS. 2A-2G illustrate a casing cementing operation performed using the drilling system 1. A conditioning fluid 130*w* may be circulated by the cement pump 30*c* through the lower manifold valve 9*b*. The conditioner 130*w* may flush the drilling fluid 130*m* from the wellbore 100, wash cuttings and/or mud cake from the wellbore, and/or adjust pH in the wellbore for pumping cement slurry 130*c*. The lower manifold valve 9*b* may then be closed. The bottom wiper 125*b* may be released from the lower launcher 8*b* and the mid manifold valve 9*m* may be opened. The cement slurry 130*c* may be pumped from the mixer 36 into the mid manifold valve 9*m* by the cement pump 30*c*, thereby propelling the bottom wiper 125*b* into the a bore of the casing 105. As the bottom wiper 125*b* is driven through the casing bore, the bottom wiper may displace the conditioner 130*w* from the casing bore into an annulus 110 formed between an outer surface of the casing 105 and an inner surface of the wellbore 100 (or the existing casing 101). The bottom wiper 125*b* may also protect the cement slurry 130*c* from dilution by the conditioner 130*w*.

Once the desired quantity of cement slurry 130*c* has been pumped, the mid manifold valve 9*b* may be closed, the top wiper 125*u* may be released from the upper launcher 8*u*, and the upper manifold valve 9*u* may be opened. Displacement (aka chase) fluid 130*d* may be pumped from the mud pit 31 into the upper manifold valve 9*u* by the cement pump 30*c*, thereby propelling the top wiper 130*u* into the casing bore. The displacement fluid 130*d* may have a density less or substantially less than the cement slurry 130*c* so that the casing 105 is in compression during curing of the cement slurry. The displacement fluid 130*d* may be drilling fluid.

Pumping of the displacement fluid 130*d* by the cement pump 30*c* may continue until residual cement in the cement discharge conduit has been purged. Pumping of the displacement fluid 130*d* may then be transferred to the mud pump 30*m* by closing the upper manifold valve 9*u* and opening the Kelly valve 11. As the top wiper 125*u* is driven through the casing bore, the bottom wiper 125*b* may land onto the float collar 108. Continued pumping of the displacement fluid 130*d* may exert pressure on the bottom wiper 125*b* until a diaphragm thereof ruptures. Rupture of the diaphragm may open a flow passage through the bottom wiper 125*b* and the cement slurry 130*c* may flow through the passage and the float valve and into the annulus 110. Pumping of the displacement fluid 130*d* may continue until the top wiper 130*u* lands onto the bottom wiper 130*b*. Landing of the top wiper 130*u* may increase pressure in the casing bore and be detected by the PLC 25 monitoring the standpipe pressure. Once landing has been detected, pumping of the displacement fluid 130*d* may be halted and the pressure in the casing bore may be bled. The float valve may close, thereby preventing the cement slurry 130*c* from flowing back into the casing bore above the float collar 108 (aka U-tubing).

Alternatively, instead of landing the casing hanger 24 into the wellhead 21 before the cementing operation, the top drive 12 may suspend the casing 105 so that the hanger is above the wellhead so that the casing may be reciprocated by the drawworks 16 and/or rotated by the top drive during the cementing operation. In this alternative, the manifold 18 may include flexible conduit to accommodate reciprocation and/or the cementing head 10 may include one or more cementing swivels to accommodate rotation. Alternatively, spacer fluid (not shown) may be pumped between the cement slurry 130*c* and the bottom wiper 125*b*.

Figure 3A:
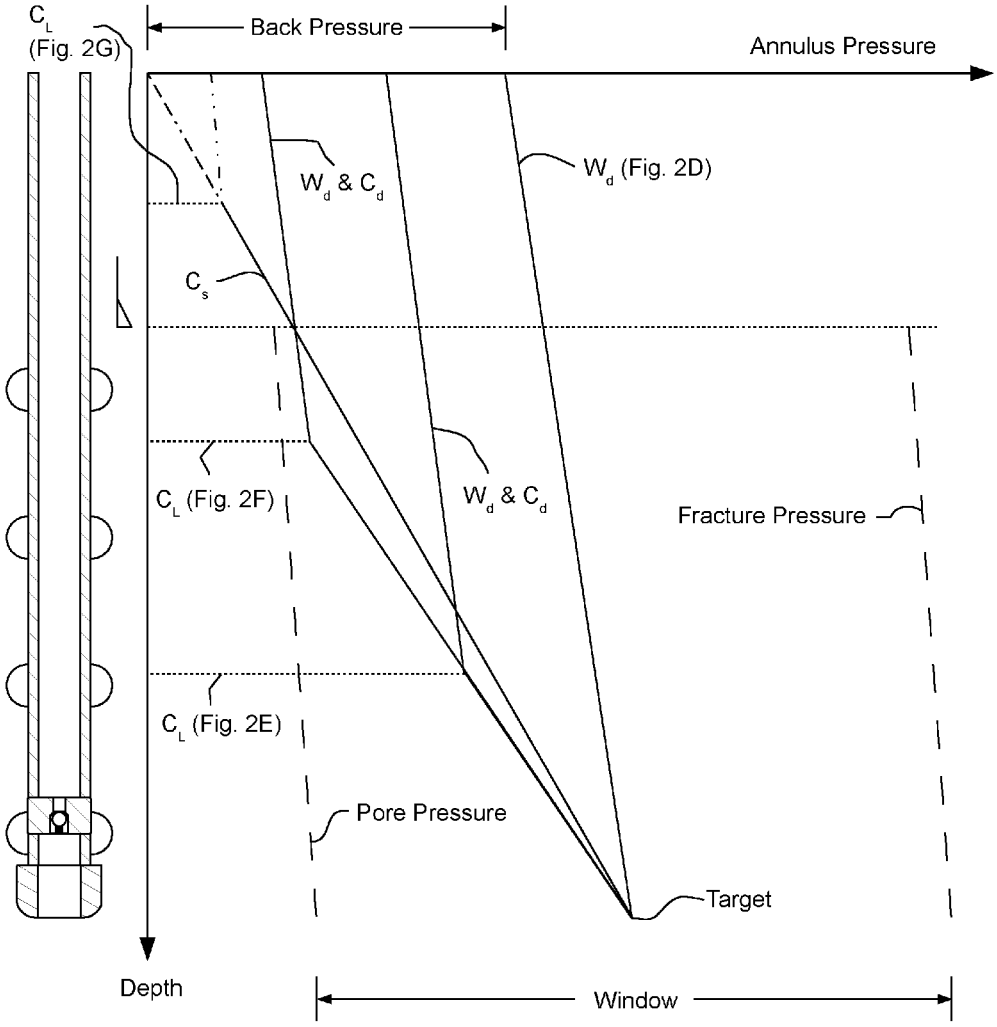
FIG. 3A illustrates operation of a programmable logic controller (PLC) of the drilling system during the casing cementing operation.
Figures 3B, 3C, 3D:
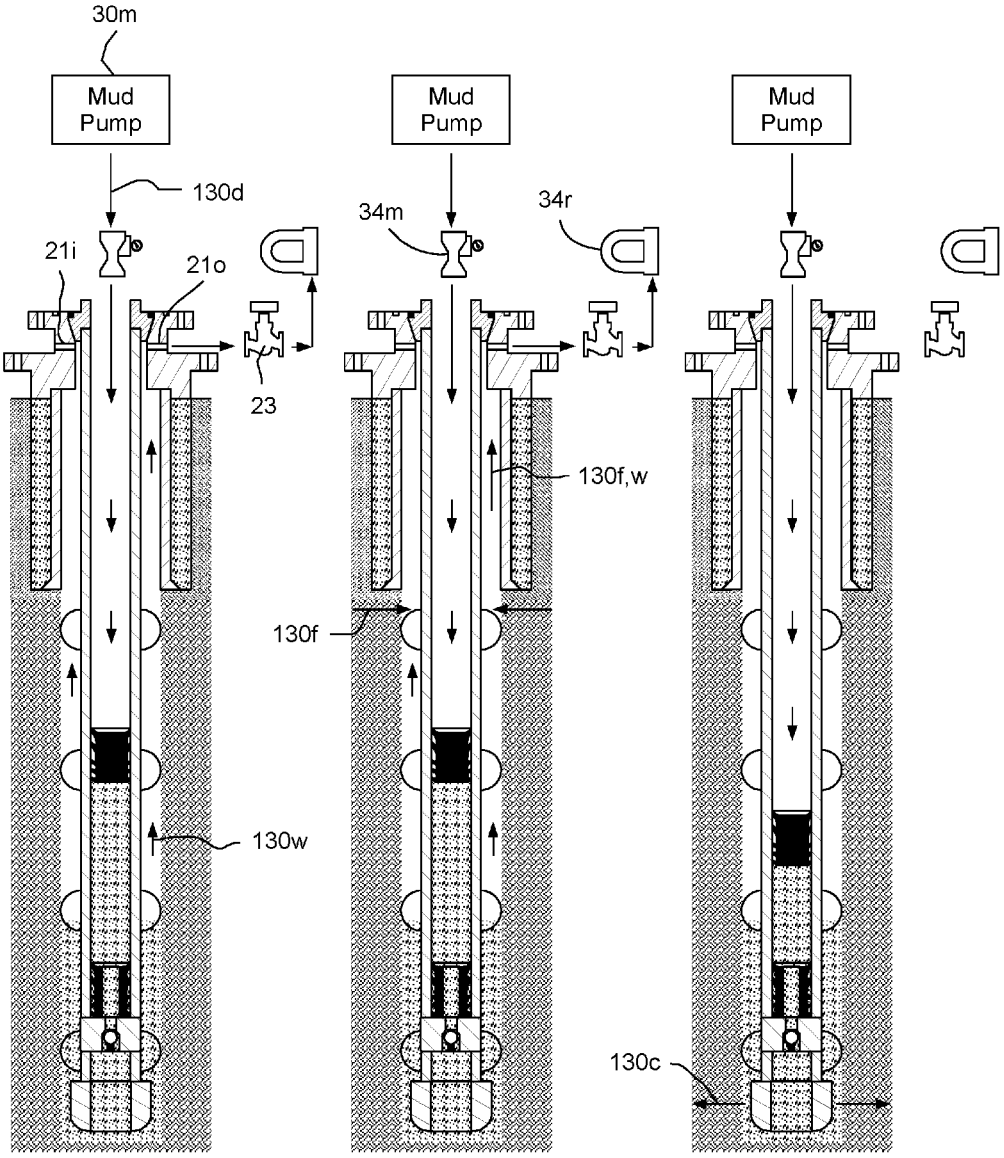
FIG. 3B illustrates monitoring of the cementing operation.
FIG. 3C illustrates detection of formation influx during cementing.
FIG. 3D illustrates detection of cement loss during cementing.

FIG. 3A illustrates operation of the PLC 25 during the casing cementing operation. FIG. 3B illustrates monitoring of the cementing operation. FIG. 3C illustrates detection of formation influx during cementing. FIG. 3D illustrates detection of cement loss during cementing.

The PLC 25 may be programmed to operate the choke 23 so that a target bottomhole pressure (BHP) is maintained in the annulus 110 during the cementing operation. The target BHP may be selected to be within a window defined as greater than or equal to a minimum threshold pressure, such as pore pressure, of the lower formation 104*b* and less than or equal to a maximum threshold pressure, such as fracture pressure, of the lower formation, such as an average of the pore and fracture BHPs. Alternatively, the minimum threshold may be stability pressure and/or the maximum threshold may be leakoff pressure. Alternatively, threshold pressure gradients may be used instead of pressures and the gradients may be at other depths along the lower formation 104*b* besides total depth, such as the depth of the maximum pore gradient and the depth of the minimum fracture gradient. Alternatively, the PLC 25 may be free to vary the BHP within the window during the cementing operation.

During the cementing operation, the PLC 25 may execute a real time simulation of the cementing operation in order to predict the actual BHP from measured data, such as manifold pressure from sensor 35*c*, cement pump flow rate from flow meter 34*c*, wellhead pressure from sensor 35*r*, and returns flow rate from the flow meter 34*r*. The PLC may then compare the predicted BHP to the target BHP and adjust the choke accordingly. At the initial stages of the cementing operation (FIGS. 2A-2C), the annulus 110 may be filled with the conditioner 130*w* having an equivalent circulation density (ECD) $W_d$ (static density plus dynamic friction drag). The conditioner ECD $W_d$ may be less or substantially less than an ECD $C_d$ of the cement 130*c*. The conditioner ECD $W_d$ may also be insufficient to maintain the target BHP without the addition of backpressure from the choke 23.

A static density $C_s$ of the cement 130*c* may be selected to exert a BHP corresponding to the target BHP at the conclusion of the cementing operation. As cement flows into the annulus 110 (FIG. 2E), the actual BHP may begin to be influenced by the cement ECD $C_d$ (aka dual gradient effect). The PLC 25 may anticipate the dual gradient effect in the predicted BHP and reduce the backpressure accordingly by relaxing the choke 23. The PLC 25 may continue to relax the choke 23 as a level $C_L$ of cement in the annulus 110 rises and the influence of the cement ECD $C_d$ on the BHP increases to maintain parity of the actual/predicted BHP with the target BHP.

The PLC 25 may also perform a mass balance during the cementing operation. Although FIGS. 3B-3D illustrate the PLC 25 performing the mass balance during displacement of the cement slurry 130*c* into the annulus 110, the PLC may also perform the mass balance during the rest of the cementing operation, such as during conditioning and propulsion of the bottom wiper 125*b* by pumping the cement slurry. As the propellant (displacement fluid 130*d* shown) is being pumped into the wellbore 100 by the mud pump 30*m* (or cement pump 30*c*) and the return fluid (conditioner 130*w* shown) is being received by the wellhead outlet 21*o*, the PLC 25 may compare the propellant mass flow rate to the return fluid flow rate (i.e., propellant rate minus return fluid rate) using the flow meters 34*m,r* (or 34*c,r*).

The PLC 25 may use the mass balance to monitor for formation fluid 130*f* entering the annulus 110 (FIG. 3C) or cement slurry 130*c* (or return fluid) entering the formation 104*b* (FIG. 3D). Upon detection of either event, the PLC 25 may take remedial action, such as tightening the choke 23 in response to detection of formation fluid 130*f* entering the annulus 110 and relaxing the choke in response to cement 130*c* entering the formation 104*b*. The PLC 25 may also alert an operator to reduce a flow rate of the respective pump and reduce the target BHP in response to detection of fluid egress into the formation. The PLC 25 may also alert the operator to increase a flow rate of the respective pump and increase the target BHP in response to detection of fluid ingress to the annulus. Alternatively, the PLC 25 may be in communication with one or more of the pumps and the PLC may take remedial action autonomously or semi-autonomously. The PLC 25 may also divert the return fluid flow into the degassing spool as part of the remedial action.

The PLC 25 may also use the flow meters 34*r,c,m* to calculate the cement level $C_L$ in the annulus. The PLC 25 may account for cement slurry egress in the cement level calculation. The PLC 25 may also use the flow meters 34*r,c,m* calculate other events during the cementing operation, such as seating of the wipers 125*u,b* and/or completion of conditioner circulation (annulus 110 filled with conditioner 130*w*).

Figures 3E, 3F, 3G:
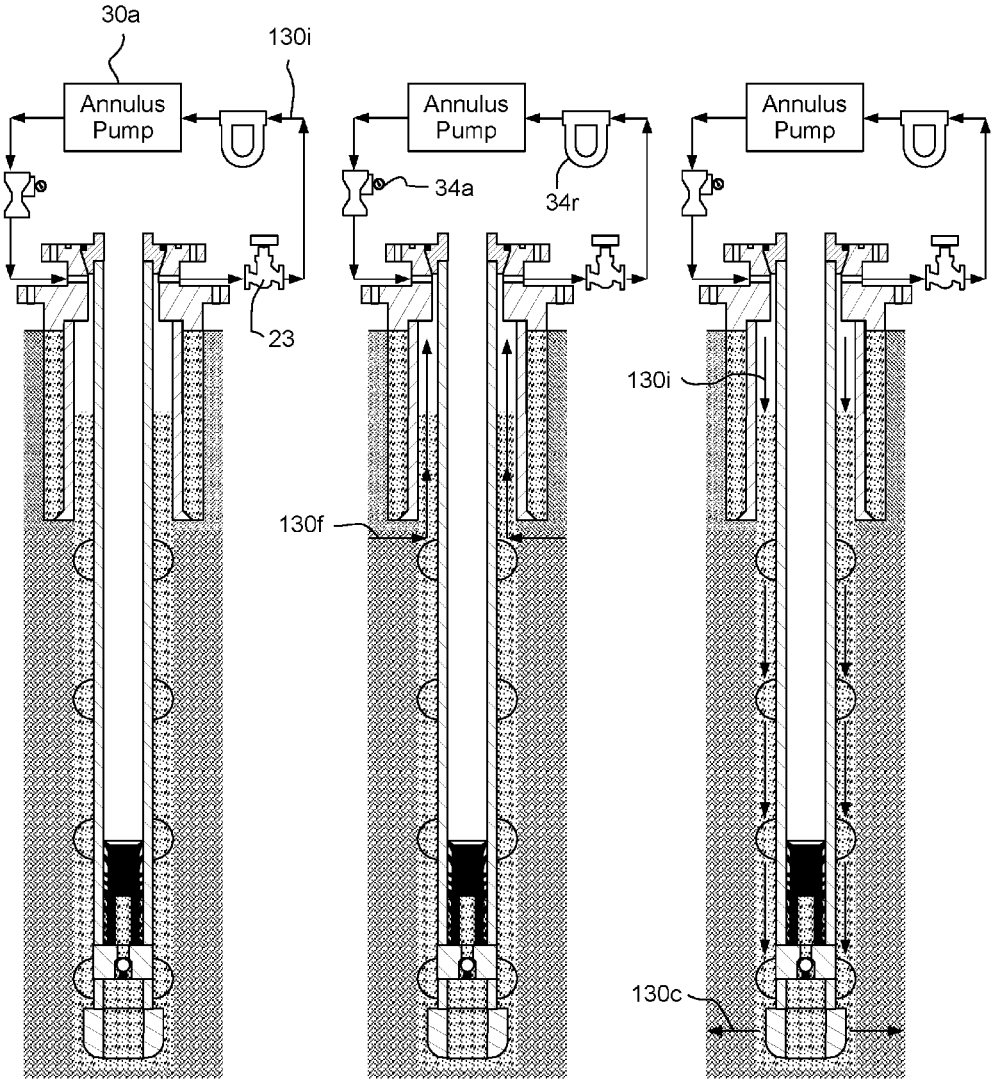
FIG. 3E illustrates monitoring of curing of the cement slurry and application of a beneficial amount of backpressure on the annulus.
FIG. 3F illustrates detection of formation influx during curing.
FIG. 3G illustrates detection of cement loss during curing.

FIG. 3E illustrates monitoring of curing of the cement slurry 130*c* and application of a beneficial amount of backpressure on the annulus 110. FIG. 3F illustrates detection of formation influx during curing. FIG. 3G illustrates detection of cement loss during curing. Once the casing bore has been bled, the annulus pump 30*a* may be operated to pump indicator fluid 130*i* from the pit 31 into the inlet port 21*i*. The indicator fluid 130*i* may flow radially across the wellhead 21 and exit the wellhead 21 at the outlet port 21*o*. The indicator fluid path may be in fluid communication with the annulus 110, thereby forming a tee having the annulus as a stagnant branch. The indicator fluid 130*i* may continue through the choke 23, returns flow meter 34*r*, and shaker 33 and back to the mud pit 31. Circulation of the indicator fluid 130*i* may be maintained during the curing period. As the indicator fluid 130*i* is being circulated, the PLC 25 may perform a mass balance between entry and exit of the indicator fluid into/from the wellhead 21 to monitor for formation fluid 130*f* entering the annulus 110 (FIG. 3F) or cement slurry 130*c* entering the formation 104*b* (FIG. 3G) using the flow meters 34*a,r*. The PLC 25 may tighten the choke 23 in response to detection of formation fluid 130*f* entering the annulus 110 and relax the choke in response to cement slurry 130*c* entering the formation 104*b*. The PLC 25 may also divert the return fluid flow into the degassing spool in response to detection of either event.

The PLC 25 may also be programmed to discern between formation fluid 130*f* continuously flowing into the annulus 110 or cement 130*c* continuously flowing into the formation 104*b* and opening or closing of micro-fractures in the formation during cementing and/or curing (aka ballooning) by calculating and monitoring a rate of change of the mass balance with respect to time (delta balance) and comparing the delta balance to a predetermined threshold.

The PLC 25 may keep a cumulative record during the cementing and curing operation of any fluid ingress/egress events, discussed above, and the PLC may make an evaluation as to the acceptability of the cured cement bond. The PLC 25 may also determine and include the final cement level $C_L$ in the evaluation. Should the PLC 25 determine that the cured cement is unacceptable, the PLC may make recommendations for remedial action, such as a cement bond/evaluation log and/or a secondary cementing operation.

Figure 4A:
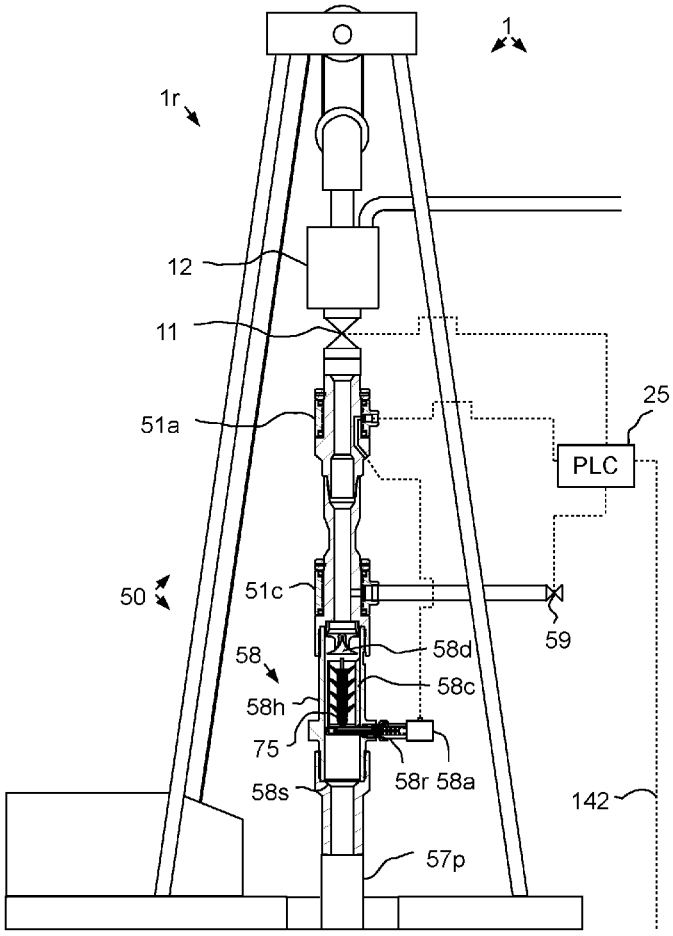
FIGS. 4A and 4B illustrates a portion of the drilling system in a liner cementing mode, according to another embodiment of the present invention.
Figure 4C:
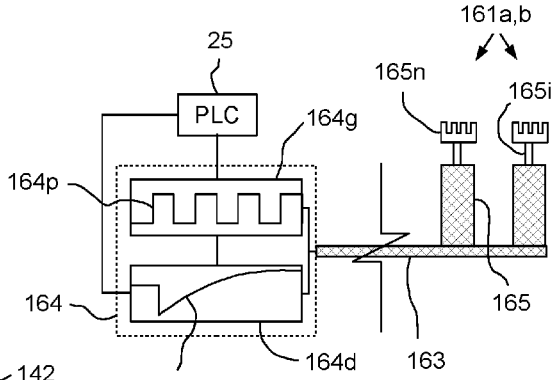
FIG. 4C illustrates operation of cement sensors.
Figure 4B:
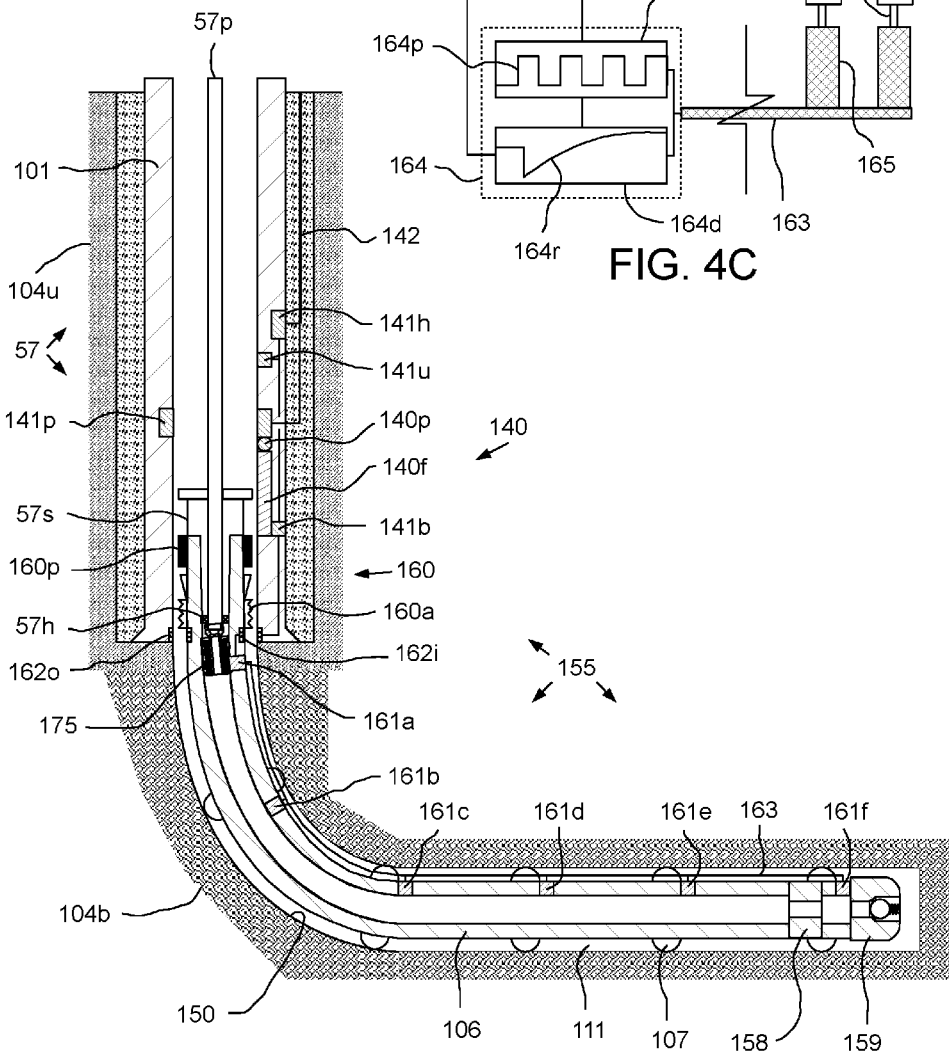
Figure 5A:
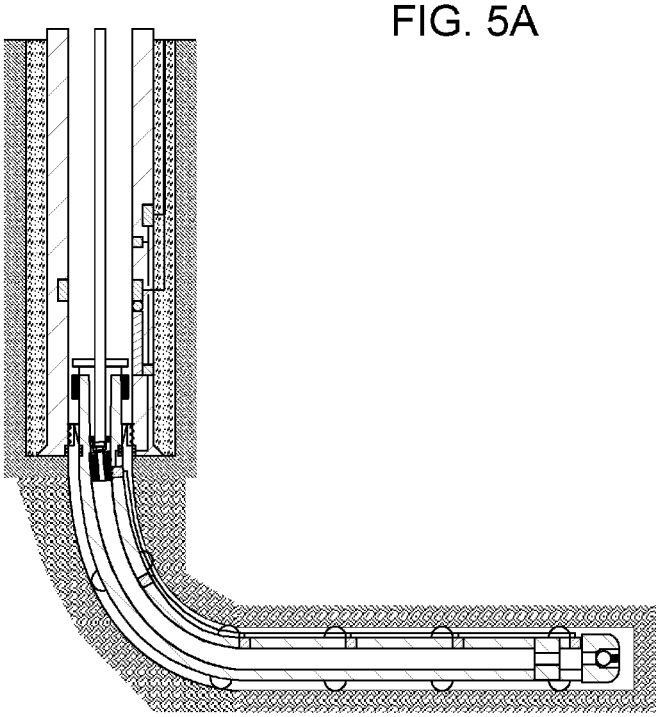
FIGS. 5A-5F illustrate a liner cementing operation performed using the drilling system.
Figure 5B:
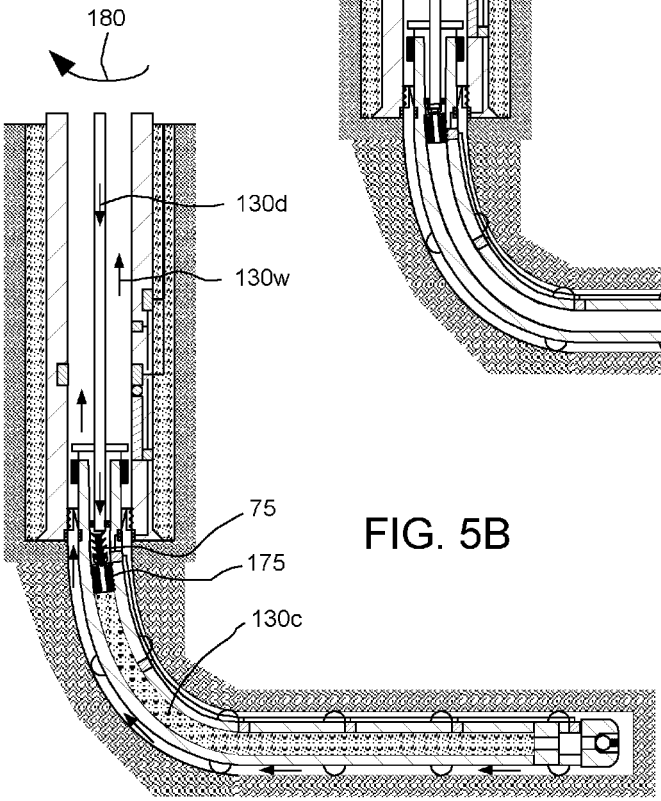
Figure 5C:
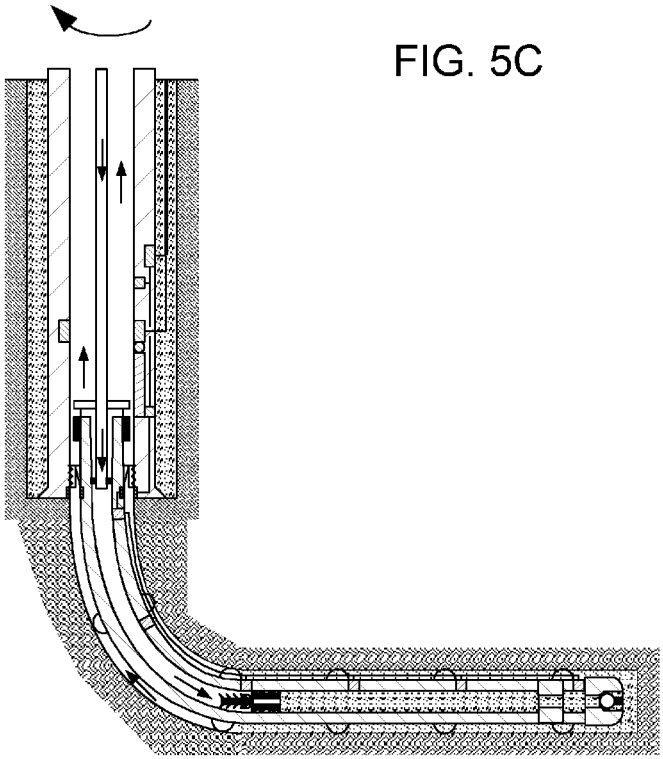
Figure 5D:
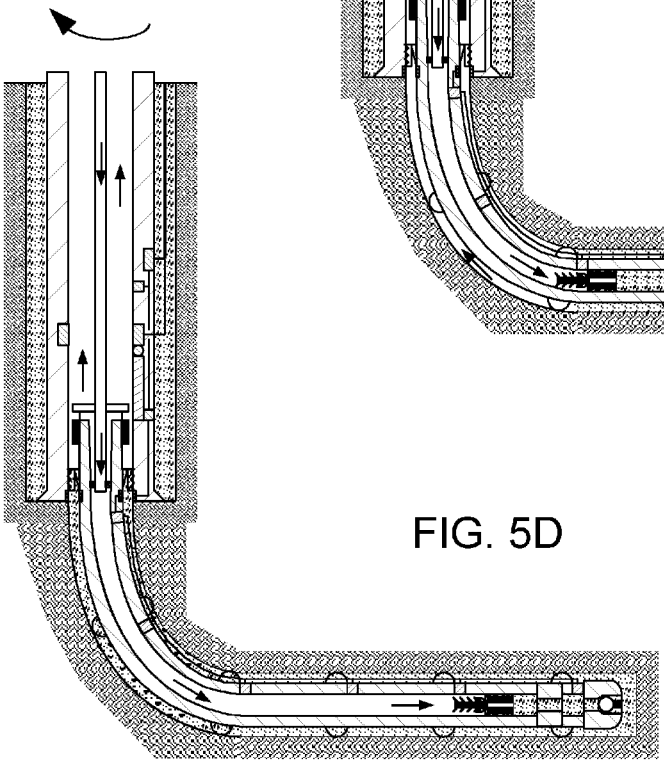
Figure 5E:
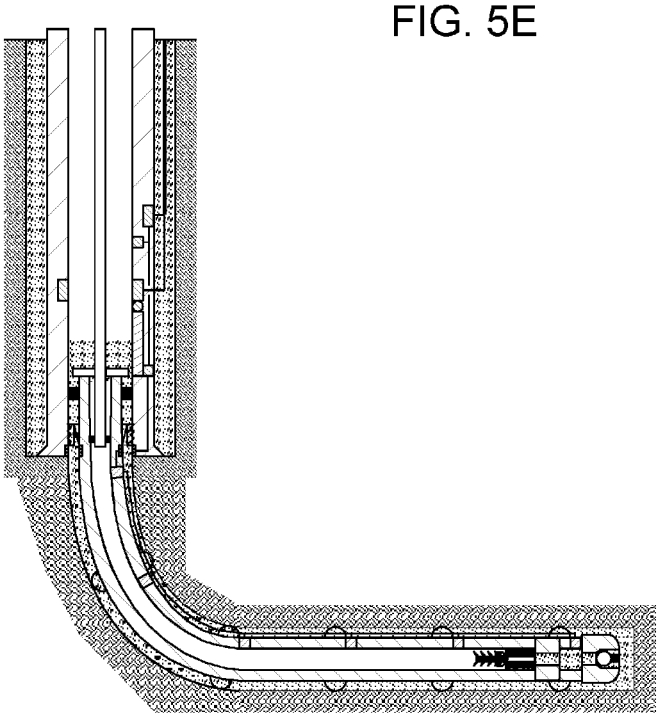
Figure 5F:
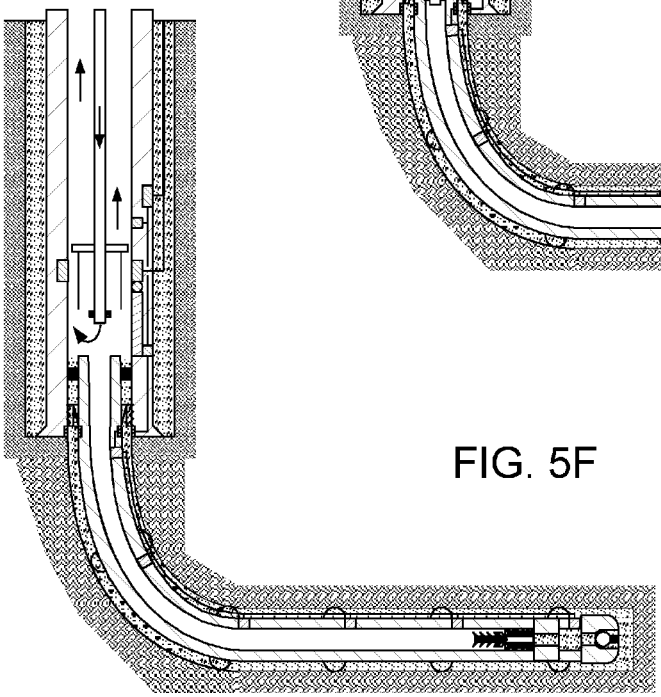

FIGS. 4A and 4B illustrates a portion of the drilling system 1 in a liner cementing mode, according to another embodiment of the present invention. A wellbore 150 may include a vertical portion and a deviated, such as horizontal, portion instead of the vertical wellbore 100. The wellbore 150 may be terrestrial or subsea. A cementing head 50 may be used instead of the cementing head 10 and a workstring 57 may be used instead of the casing adapter 7. The workstring 57 may include joints of tubulars, such as drill pipe 57*p*, connected together, such as by threaded connections, a seal head 57*h*, and a setting tool 57*s*. The setting tool 57*s* may connect a liner string 155 to the workstring 57. The workstring 57 may also be connected to the cementing head 50. The cementing head 50 may also be connected to the Kelly valve 11.

The cementing head 50 may include an actuator swivel 51*a*, a cementing swivel 51*c*, and a launcher 58. Each swivel 51*a,c* may include a housing torsionally connected to the derrick 2, such as by bars, wire rope, or a bracket (not shown). Each torsional connection may accommodate longitudinal movement of the respective swivel 51*a,c* relative to the derrick 2. Each swivel 51*a,c* may further include a mandrel and bearings for supporting the housing from the mandrel while accommodating relative rotation therebetween. The cementing swivel 51*c* may further include an inlet formed through a wall of the housing and in fluid communication with a port formed through the mandrel and a seal assembly for isolating the inlet-port communication. The cementing swivel inlet may be connected to the cement pump 30*c* via shutoff valve 59. The shutoff valve 59 may be automated and have a hydraulic actuator (not shown) operable by the PLC 25 via fluid communication with the HPU. Alternatively, the shutoff valve actuator may be pneumatic or electric. The cementing mandrel port may provide fluid communication between a bore of the cementing head 50 and the housing inlet. Each seal assembly may include one or more stacks of V-shaped seal rings, such as opposing stacks, disposed between the mandrel and the housing and straddling the inlet-port interface. Alternatively, the seal assembly may include rotary seals, such as mechanical face seals.

The actuator swivel 51*a* may be hydraulic and may include a housing inlet formed through a wall of the housing and in fluid communication with a passage formed through the mandrel, and a seal assembly for isolating the inlet-passage communication. The passage may extend to an outlet of the mandrel for connection to a hydraulic conduit for operating a hydraulic actuator 58*a* of the cementing head 10. The actuator swivel 51*a* may be in fluid communication with the HPU. Alternatively, the actuator swivel and cementing head actuator may be pneumatic or electric. The Kelly valve 11 may also be automated and include a hydraulic actuator (not shown) operable by the PLC 25 via fluid communication with the HPU. The cementing head 50 may further include an additional actuator swivel (not shown) for operation of the Kelly valve 11 or the top drive 12 may include the additional actuator swivel. Alternatively, the Kelly valve actuator may be electric or pneumatic.

The launcher 58 may include a housing 58*h*, a diverter 58*d*, a canister 58*c*, a latch 58*r*, and the actuator 58*a*. The housing 58*h* may be tubular and may have a bore therethrough and a coupling formed at each longitudinal end thereof, such as threaded couplings. Alternatively, the upper housing coupling may be a flange. To facilitate assembly, the housing 58*h* may include two or more sections (three shown) connected together, such as by a threaded connection. The housing 58*h* may also serve as the cementing swivel housing (shown) or the launcher and cementing swivel 51*c* may have separate housings (not shown). The housing 58*h* may further have a landing shoulder 58*s* formed in an inner surface thereof. The canister 58*c* and diverter 58*d* may each be disposed in the housing bore. The diverter 58*d* may be connected to the housing 58*h*, such as by a threaded connection. The canister 58*c* may be longitudinally movable relative to the housing 58*h*. The canister 58*c* may be tubular and have ribs formed along and around an outer surface thereof. Bypass passages may be formed between the ribs. The canister 58*c* may further have a landing shoulder formed in a lower end thereof corresponding to the housing landing shoulder 58*s*. The diverter 58*d* may be operable to deflect cement slurry 130*c* or displacement fluid 130*d* away from a bore of the canister and toward the bypass passages. A cementing plug, such as dart 75, may be disposed in the canister bore for selective release and pumping downhole to activate a cementing plug, such as wiper 175, releasably connected to the setting tool 57*s*.

The latch 58*r* may include a body, a plunger, and a shaft. The body may be connected to a lug formed in an outer surface of the launcher housing 58*h*, such as by a threaded connection. The plunger may be longitudinally movable relative to the body and radially movable relative to the housing 58*h* between a capture position and a release position. The plunger may be moved between the positions by interaction, such as a jackscrew, with the shaft. The shaft may be longitudinally connected to and rotatable relative to the body. The actuator 58*a* may be a hydraulic motor operable to rotate the shaft relative to the body. Alternatively, the actuator may be linear, such as a piston and cylinder. Alternatively, the actuator may be electric or pneumatic. Alternatively, the actuator may be manual, such as a handwheel.

In operation, the PLC 25 may release the dart 75 by operating the HPU to supply hydraulic fluid to the actuator 58*a* via the actuator swivel 51*a*. The actuator 58*a* may then move the plunger to the release position (not shown). The canister 58*c* and dart 75 may then move downward relative to the housing 58*h* until the landing shoulders 58*s* engage. Engagement of the landing shoulders 58*s* may close the canister bypass passages, thereby forcing displacement fluid 130*d* to flow into the canister bore. The displacement fluid 130*d* may then propel the dart 75 from the canister bore into a lower bore of the housing 58*h* and onward through the drill pipe 57*p* to the wiper 175.

Additionally, the cementing head 50 may further include a launch sensor (not shown). The launch sensor may be in data communication with the PLC 25 via an additional swivel (not shown). The dart may include a magnetic or radio frequency identification tag and the launch sensor may include a receiver or transceiver for interacting with the dart tag, thereby detecting launch of the dart. The launch sensor may then report launch detection to the PLC 25.

Alternatively, the launcher may include a main body having a main bore and a parallel side bore, with both bores being machined integral to the main body. The dart 75 may be loaded into the main bore, and a dart releaser valve may be provided below the dart to maintain it in the capture position. The dart releaser valve may be side-mounted externally and extend through the main body. A port in the dart releaser valve may provide fluid communication between the main bore and the side bore. When pumping cement slurry 130*c*, the dart 75 may be maintained in the main bore with the dart releaser valve closed. The slurry 130*c* may flow through the side bore and into the main bore below the dart via the fluid communication port in the dart releaser valve. To release the dart 75, the dart releaser valve may be turned, such as by ninety degrees, thereby closing the side bore and opening the main bore through the dart releaser valve. The displacement fluid 130*d* may then enter the main bore behind the dart, causing it to drop downhole.

To facilitate removal of the drill string and deployment of the liner string 155, the outer casing 101 may include an isolation valve 140. The isolation valve 140 may include a tubular housing, a flow tube (not shown), and a closure member, such as a flapper 140*f*. Alternatively, the closure member may be a ball (not shown) instead of the flapper. To facilitate manufacturing and assembly, the housing may include one or more sections connected together, such as fastened with threaded connections and/or fasteners. The housing may have a longitudinal bore formed therethrough for passage of a tubular string. The flow tube may be disposed within the housing. The flow tube may be longitudinally movable relative to the housing. A piston (not shown) may be formed in or fastened to an outer surface of the flow tube. The flow tube may be longitudinally movable by the piston between the open position and the closed position. In the closed position, the flow tube may be clear from the flapper 140*f*, thereby allowing the flapper to close. In the open position, the flow tube may engage the flapper 140*f*, push the flapper to the open position, and engage a seat formed in or disposed in the housing. Engagement of the flow tube with the seat may form a chamber between the flow tube and the housing, thereby protecting the flapper 140*f* and the flapper seat. The flapper 140*f* may be pivoted to the housing, such as by a fastener 140*p*. A biasing member, such as a torsion spring (not shown) may engage the flapper 140*f* and the housing and be disposed about the fastener 140*p* to bias the flapper toward the closed position. In the closed position, the flapper 140*f* may fluidly isolate an upper portion of the valve 140 (and an upper portion of the wellbore 150) from a lower portion of the valve (and the formation 104*b*).

The valve 140 may be in communication with the PLC 25 via a control line 142. The control line 142 may include hydraulic conduits providing fluid communication between the HPU and the flow tube piston for opening and closing the valve 140. The control line 142 may further include a data conduit for providing data communication between the PLC 25 and the valve 140. The control line data conduit may be electrical or optical. The valve 140 may further include a cablehead 141*h* for receiving the control line cable.

The valve 140 may further include one or more sensors, such as an upper pressure sensor 141*u*, a lower pressure sensor 141*b*, and a position sensor 141*p*. The upper pressure sensor 141*u* may be in fluid communication with the housing bore above the flapper 140*f* and the lower pressure sensor 141*b* may be in fluid communication with the housing bore below the flapper. Lead wires may provide data communication between the control line 142 and the sensors 141*u,b,p*. The position sensor 141*p* may be able to detect when the flow tube is in the open position, the closed position, or at any position between the open and closed positions so that the PLC 25 may monitor full or partial opening of the valve 140. The sensors may be powered by the data conduit of the control line 142 or the valve 140 may include a battery pack.

The liner string 155 may include a plurality of casing joints 106 connected to each other, such as by threaded connections, one or more centralizers 107 spaced along the liner string at regular intervals, a landing collar 158, a float shoe 159, a liner hanger 160, one or more cement sensors 161*a-f*, and a wireless data coupling 162*i*. The shoe 159 may be disposed at the lower end of the joints 106 and have a bore formed therethrough. The shoe 159 may be convex for guiding the liner string 155 toward the center of the wellbore 150. An outer portion of the shoe 159 may be made from the casing material, discussed above. An inner portion of the shoe 159 may be made of the drillable material, discussed above. The shoe 159 may include the check valve, discussed above.

The liner hanger 160 may include an anchor 160*a* and a packoff 160*p*. The anchor 160*a* may be operable to engage the casing 101 and longitudinally support the liner string 155 from the casing 101. The anchor 160*a* may include slips and a cone. The anchor 160*a* may accommodate relative rotation between the liner string 155 and the casing 101, such as by including a bearing (not shown). The packoff 160*p* may be operable to radially expand into engagement with an inner surface of the casing 101, thereby isolating the liner-casing interface. The setting tool 57*s* may be operable to set the anchor and packoff independently. The setting tool 57*s* may include a seat for receiving a blocking member, such as a ball (not shown). The cementing head 50 may further include an additional launcher (not shown) for deploying the ball.

Once landed, a setting piston (not shown) of the setting tool 57*s* may be operated to set the anchor 160*a* by increasing fluid pressure in the workstring 57 against the seated ball. Setting of the anchor 160*a* may be confirmed by pulling the workstring 57. Additional pressure may then be exerted to longitudinally release the setting tool 57*s* from the liner string 155. Alternatively, the setting tool 57*s* may be released by rotation of the workstring 57. Release of the setting tool 57*s* may be confirmed by pulling the workstring 57. Further additional pressure may be exerted to release the ball from the seat. After cementing, the packoff 160*p* may be set by articulation of the workstring 57. Alternatively, the anchor 160*a* may also be set by articulation of the workstring 57.

FIG. 4C illustrates operation of the cement sensors 161*a-f*. The cement sensors 161*a-f* may each be capacitance sensors and may be spaced along the joints 106 and connected by a data cable 163. The data cable 163 may be electrical or optical and the cement sensors 161*a-f* may be powered via the data cable 163 or have batteries. The data cable may extend along an outer surface of the casing joints 106 and fastened thereto, be disposed in a groove formed in an outer surface of the casing joints, or be disposed in segments within a wall of the casing joints and connected by couplings disposed in an end of each casing joint. The cement sensors 161*a-f* may be in fluid communication with an annulus 111 formed between liner string 155 and the wellbore 150. The data cable 163 may be connected to the data coupling 162*i*. The data coupling 162*i* may be in communication with a corresponding data coupling 162*o* of the casing string 101. The data couplings 162*i,o* may be inductive, capacitive, radio frequency, or acoustic couplings and may provide data communication without contact and may accommodate misalignment. The casing coupling 162*o* may be in data communication with the control line 142 via a lead wire. The control line data cable and couplings 162*i,o* may provide data communication between the cement sensors 161*a-f* and a sampling head 164. The sampling head 164 may be located at surface 104*s* and be in data communication with the PLC 25.

The cement sensors 161*a-f* may each include a semi-rigid coaxial cable 165 having a short section of inner conductor 165*i* protruding at its tip. Since the exposed tip 165*i* may be an effective radiator in high-permittivity liquids, it may be shielded, such as by a serrated castle nut 165*n*. The serrated castle nut 165*n* may provide a surrounding ground plane while allowing free-flow of cement slurry 130*c* through the tip 165*i*. Additionally, each cement sensor 161*a-f* may be part of a cement sensor assembly further including a pressure and/or temperature sensor. Alternatively, each cement sensor 161*a-f* may be a pressure and/or temperature sensor instead of a capacitance sensor.

The sampling head 164 may include a pulse generator 164*g* and a pulse detector 164*d*. The pulse generator 164*g* may supply a step function incident pulse 164*p* to the data cable 163. Each sensor 161*a-f* may reflect a return pulse 164*r* back to the pulse detector 164*d*. Alternatively, the sampling head 164 may be located in the liner hanger 160 or the outer casing string 101 as a part thereof.

FIGS. 5A-5F illustrate a liner cementing operation performed using the drilling system 1. As discussed above for the casing cementing operation, conditioner 130*w* may be circulated (not shown) by the cement pump 30*c* through the valve 59 or by the mud pump 30*m* via the top drive 12 to prepare for pumping of the cement slurry 130*c*. The anchor 160*a* may then be set and the setting tool 57*s* released from the liner 155, as discussed above. The workstring 57 and liner 155 may then be rotated 180 from surface by the top drive 12 and rotation may continue during the cementing operation. Cement slurry 130*c* may be pumped from the mixer 36 into the cementing swivel 50*c* via the valve 59 by the cement pump 30*c*. The cement slurry 130*c* may flow into the launcher 58 and be diverted past the dart 75 via the diverter 58*d* and bypass passages.

Once the desired quantity of cement slurry 130*c* has been pumped, the cementing dart 75 may be released from the launcher 58 by the PLC 25 operating the actuator 58*a*. Displacement fluid 130*d* may be pumped into the cementing swivel 51*c* via the valve 59 by the cement pump 30*c*. The displacement fluid 130*d* may flow into the launcher 58 and be forced behind the dart 75 by closing of the bypass passages, thereby propelling the dart into the workstring bore. Pumping of the displacement fluid 130*d* by the cement pump 30*c* may continue until residual cement in the cement discharge conduit has been purged. Pumping of the displacement fluid 130*d* may then be transferred to the mud pump 30*m* by closing the valve 59 and opening the Kelly valve 11. The dart 75 may be driven through the workstring bore by the displacement fluid 130*d* until the dart lands onto the wiper 175, thereby closing a bore of the wiper. Continued pumping of the displacement fluid 130*d* may exert pressure on the seated dart 75 until the wiper 175 is released from the setting tool 57*s*.

Once released, the combined dart and wiper 75,175 may be driven through the liner bore by the displacement fluid 130*d*, thereby driving cement slurry 130*c* through the float shoe 159 and into the annulus 111. Pumping of the displacement fluid 130*d* may continue until the combined dart and wiper 75,175 land on the collar 158. Landing of the combined dart and wiper 75,175 may increase pressure in the liner 155 and workstring bore and be detected by the PLC 25 monitoring the standpipe pressure. Once landing has been detected, pumping of the displacement fluid 130*d* and rotation 180 of the liner 155 may be halted and the packoff 160*p* set. The setting tool 57*s* may be raised from the liner hanger 160 and displacement fluid 130*d* circulated to wash away excess cement slurry. Pressure in the workstring 57 and liner bore may be bled. The float shoe 159 may close, thereby preventing the cement slurry 130*c* from flowing back into the liner bore.

Additionally, the cementing head 50 may further include a bottom dart and a bottom wiper may also be connected to the setting tool. The bottom dart may be launched before pumping of the cement 130*c*.

Figure 6:
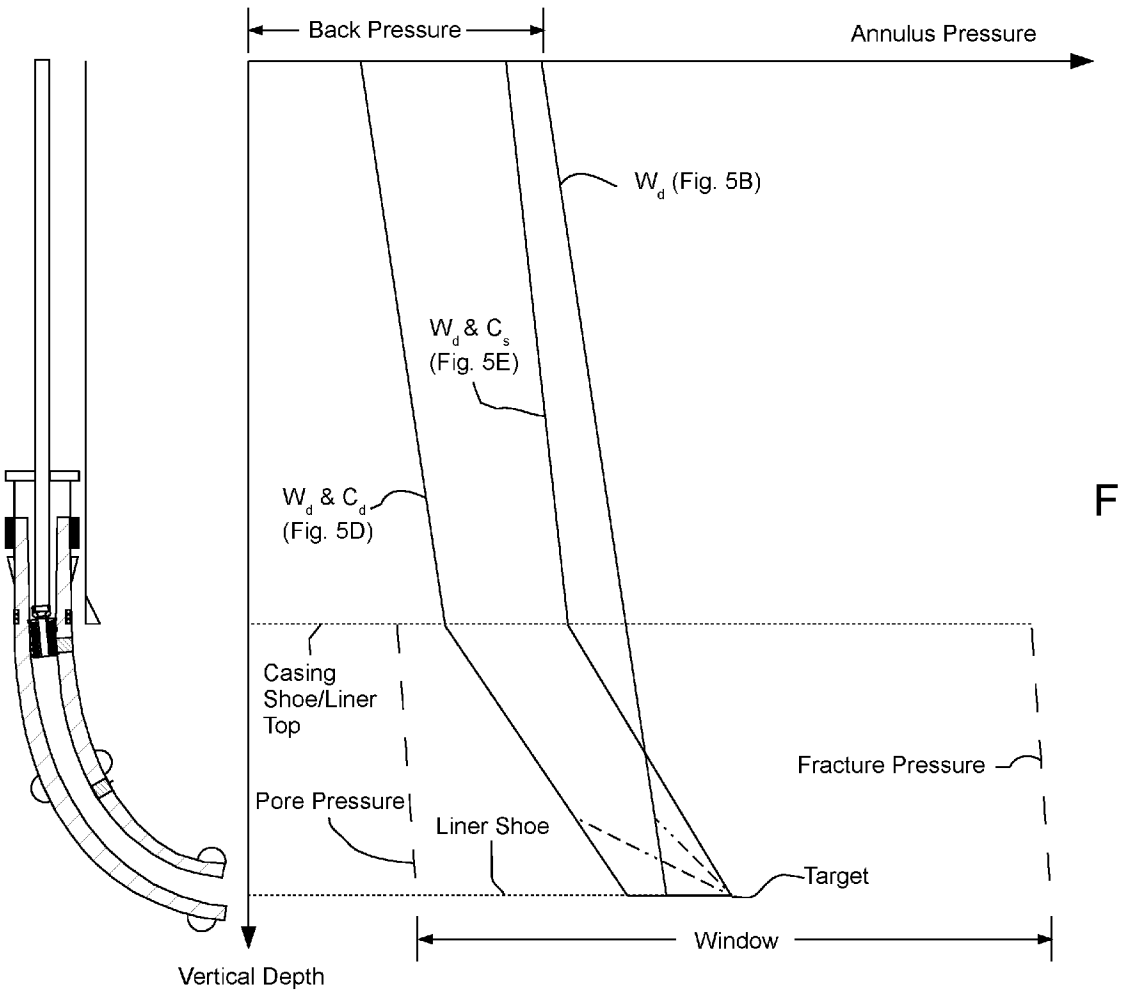
FIG. 6 illustrates operation of the PLC during the liner cementing operation.

FIG. 6 illustrates operation of the PLC 25 during the liner cementing operation. The PLC 25 may be programmed to operate the choke 23 so that the target bottomhole pressure (BHP) is maintained in the annulus 111 during the cementing operation and the PLC 25 may execute a real time simulation of the cementing operation in order to predict the actual BHP from measured data (as discussed above for the casing cementing operation). The PLC 25 may then compare the predicted BHP to the target BHP and adjust the choke 23 accordingly. At the initial stages of the cementing operation (FIGS. 5A and 5B), the annulus 111 may be filled with only the conditioner 130*w* having the ECD $W_d$. The conditioner 130*w* may have an ECD $W_d$ less or substantially less than an ECD $C_d$ of the cement 130*c*. The conditioner ECD $W_d$ may also be insufficient to maintain the target BHP without the addition of backpressure from the choke 23.

Due to the deviated portion of the wellbore 150, a static density $C_s$ of the cement 130*c* corresponding to the target BHP at the conclusion of the cementing operation may not be available as the increased ECD would likely exert a BHP exceeding the target pressure. As cement 130*c* flows into the annulus 111 (FIGS. 5C and 5D), the actual BHP may begin to be influenced by the cement ECD $C_d$.

The PLC 25 may anticipate the dual gradient effect in the predicted BHP and reduce the backpressure accordingly by relaxing the choke 23. The PLC 25 may continue to relax the choke as a level of cement 130*c* in the annulus 111 rises and the influence of the cement ECD $C_d$ on the BHP increases to maintain parity of the actual/predicted BHP with the target BHP. The PLC 25 may be in data communication with the mud pump 30*m*. Once the cement level nears the liner hanger 160, the PLC 25 may reduce a flow rate of displacement fluid 130*d* pumped by the mud pump 30*m* and tighten the choke 23 to increase backpressure while reducing the cement ECD $C_d$ so that when the cement level reaches the liner hanger 160, the choke 23 may be closed to seal the increased backpressure in the annulus 111, thereby maintaining the target BHP. The packoff 160*p* may then be set while the sealed backpressure is exerted on the annulus 111. Additionally, the annulus pump 30*a* may be operated to aid in increasing the backpressure while the mud pump 30*m* rate is being reduced.

During the cementing operation, the PLC 25 may monitor the cement sensors 161*a-f* via sampling head 164 to track the cement level in the annulus 111. The PLC 25 may also perform the mass balance during the cementing operation as discussed above for the casing cementing operation. Since the packoff 160*p* is set during curing, the PLC 25 may instead rely on the cement sensors 161*a-f* for monitoring the curing operation for formation fluid 130*f* entering the annulus 111 or cement slurry 130*c* entering the formation 104*b*. From data, such as complex permittivity, obtained from the cement sensors 161*a-f* during the curing operation and over a broadband frequency range, such as between ten kilohertz and ten gigahertz, the PLC 25 may perform a time domain reflectometry dielectric spectroscopy (TDRDS) analysis, such as by Fourier transform, during and/or after the curing operation.

From the analysis, the PLC 25 may determine one or more parameters of the curing operation, such as disappearance of water into hydration (aka free water relaxation, appearing near ten gigahertz), water attaching to developing cement microstructure (aka bound water relaxation, appearing near one hundred megahertz), local ion migration in the developing cement microstructure (aka low relaxation, appearing near one megahertz), and long range ion drift through the developing cement microstructure (aka ion conductivity, appearing below one megahertz). The PLC 25 may compare each parameter to a known benchmark for evaluating the integrity of the cured cement bond. Additionally, the PLC 25 may plot the parameters against cure time and graphically display the parameters for manual evaluation. The PLC 25 may superimpose plots for a particular parameter at the various depths of the sensors 161*a-f* with the benchmark.

Based upon monitoring and control of the cementing operation and monitoring and analysis of the curing operation, the PLC 25 may determine acceptability of the cured cement bond. Should the PLC 25 determine that the cured cement is unacceptable, the PLC may make recommendations for remedial action, such as a cement bond/evaluation log and/or a secondary cementing operation. Further, the PLC 25 may pinpoint depths of defects in the annulus 111 based on the location of the particular sensor that detected the defect. Pinpointing of the defects may facilitate the remedial action.

Alternatively, the inner casing string 105 may have the cement sensors 161*a-f* and the data cable 163 disposed therealong or at least along a portion thereof corresponding to the exposed portion of the wellbore 100.

Figure 7A:
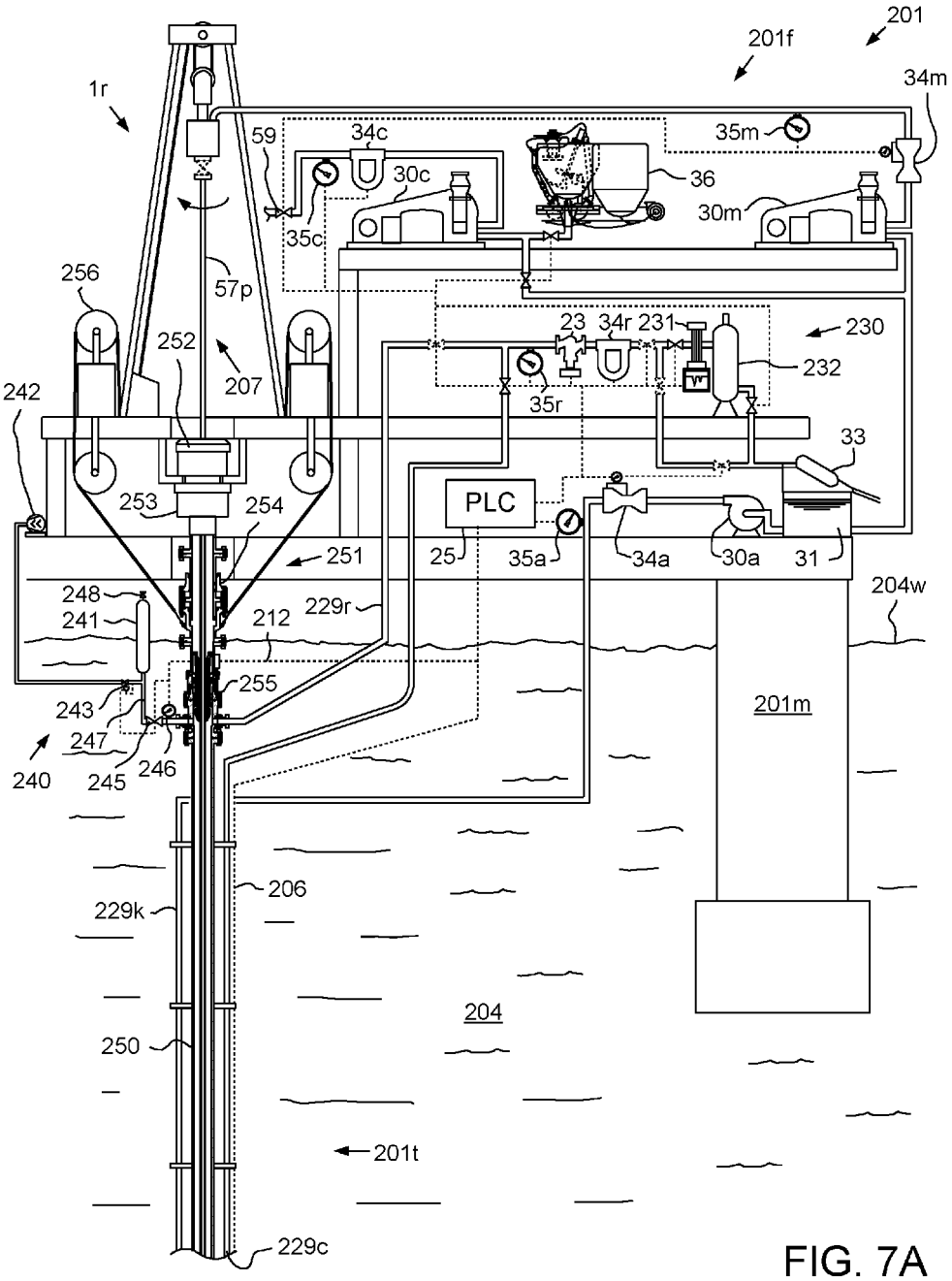
FIGS. 7A-C illustrates an offshore drilling system in a drilling mode, according to another embodiment of the present invention.
Figure 7B:
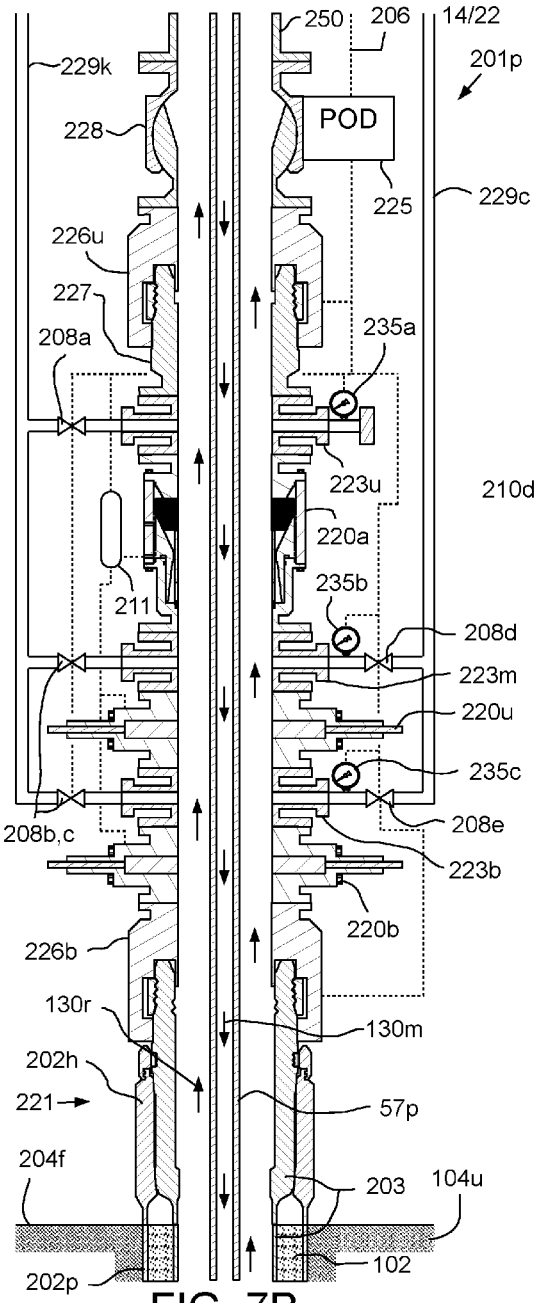
Figure 7C:
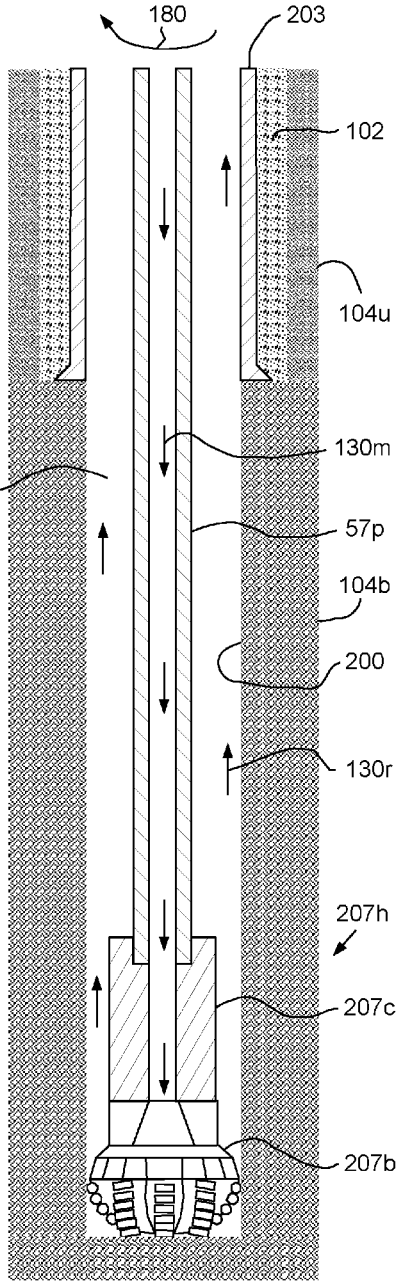

FIGS. 7A-C illustrates an offshore drilling system 201 in a drilling mode, according to another embodiment of the present invention. The drilling system 201 may include a mobile offshore drilling unit (MODU) 201*m*, such as a semi-submersible, the drilling rig 1*r*, a fluid handling system 201*f*, a fluid transport system 201*t*, and a pressure control assembly (PCA) 201*p*. Alternatively, a fixed offshore drilling unit or a non-mobile floating offshore drilling unit may be used instead of the MODU 1*m*. The MODU 1*m* may carry the drilling rig 1*r* and the fluid handling system 201*f* aboard and may include a moon pool, through which drilling operations are conducted. The semi-submersible MODU 1*m* may include a lower barge hull which floats below a surface (aka waterline) 204*w* of sea 204 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 201*f*. The MODU 1*m* may further have a dynamic positioning system (DPS) (not shown) or be moored for maintaining the moon pool in position over a subsea wellhead 221.

The drilling rig 1*r* may further include a drill string compensator (not shown) to account for heave of the MODU 1*m*. The drill string compensator may be disposed between the traveling block 13 and the top drive 12 (aka hook mounted) or between the crown block 15 and the derrick 2 (aka top mounted). The drill string 207 may include a bottomhole assembly (BHA) 207*b* and joints of drill pipe 57*p* connected together, such as by threaded couplings. The BHA 207*h* may be connected to the drill pipe 57*p*, such as by a threaded connection, and include a drill bit 207*b* and one or more drill collars 207*c* connected thereto, such as by a threaded connection. The drill bit 207*b* may be rotated 180 by the top drive 12 via the drill pipe 57*p* and/or the BHA 207*h* may further include a drilling motor (not shown) for rotating the drill bit. The BHA 207*h* may further include an instrumentation sub (not shown), such as a measurement while drilling (MWD) and/or a logging while drilling (LWD) sub.

The PCA 201*p* may be connected to a wellhead 50 located adjacent a floor 204*f* of the sea 204. A conductor string 202*p,h* may be driven into the seafloor 204*f*. The conductor string 202*p,h* may include a housing 202*h* and joints of conductor pipe 202*p* connected together, such as by threaded connections. Once the conductor string 202*p,h* has been set, a subsea wellbore 200 may be drilled into the seafloor 204*f* and an outer casing string 203 may be deployed into the wellbore 200. The outer casing string 203 may include a wellhead housing and joints of casing connected together, such as by threaded connections. The wellhead housing may land in the conductor housing during deployment of the outer casing string 203. The outer casing string 203 may be cemented 102 into the wellbore 200. The outer casing string 203 may extend to a depth adjacent a bottom of the upper formation 104*u*. Although shown as vertical, the wellbore 200 may include a vertical portion and a deviated, such as horizontal, portion.

The PCA 201*p* may include a wellhead adapter 226*b*, one or more flow crosses 223*u,m,b*, one or more blow out preventers (BOPs) 220*a,u,b*, a lower marine riser package (LMRP), one or more accumulators 211, a receiver 227 a kill line 229*k*, and a choke line 229*c*. The LMRP may include a control pod 225, a flex joint 228, and a connector 226*u*. The wellhead adapter 226*b*, flow crosses 223*u,m,b*, BOPs 220*a,u,b*, receiver 227, connector 226, and flex joint 228, may each include a housing having a longitudinal bore therethrough and may each be connected, such as by flanges, such that a continuous bore is maintained therethrough. The bore may have drift diameter, corresponding to a drift diameter of the wellhead 221.

Each of the connector 226*u* and wellhead adapter 226*b* may include one or more fasteners, such as dogs, for fastening the LMRP to the BOPs 220*a,u,b* and the PCA 201*p* to an external profile of the wellhead housing, respectively. Each of the connector 226*u* and wellhead adapter 226*b* may further include a seal sleeve for engaging an internal profile of the respective receiver 46 and wellhead housing. Each of the connector 226*u* and wellhead adapter 226*b* may be in electric or hydraulic communication with the control pod 25 and/or further include an electric or hydraulic actuator and an interface, such as a hot stab, so that a remotely operated subsea vehicle (ROV) (not shown) may operate the actuator for engaging the dogs with the external profile.

The LMRP may receive a lower end of a marine riser 250 and connect the riser to the PCA 201*p*. The control pod 225 may be in electric, hydraulic, and/or optical communication with the PLC 25 onboard the MODU 201*m* via an umbilical 206. The control pod 225 may include one or more control valves (not shown) in communication with the BOPs 220*a,u,b* for operation thereof. Each control valve may include an electric or hydraulic actuator in communication with the umbilical 206. The umbilical 206 may include one or more hydraulic or electric control conduit/cables for the actuators. The accumulators 211 may store pressurized hydraulic fluid for operating the BOPs 220*a,u,b*. Additionally, the accumulators 211 may be used for operating one or more of the other components of the PCA 201*p*. The umbilical 206 may further include hydraulic, electric, and/or optic control conduit/cables for operating various functions of the PCA 201*p*. The PLC 25 may operate the PCA 201*p* via the umbilical 206 and the control pod 225.

A lower end of the kill line 229*k* may be connected to a branch of the upper flow cross 223*u* by a shutoff valve 208*a*. A kill manifold may also connect to the kill line lower end and have a prong connected to a respective branch of each flow cross 223*m,b*. Shutoff valves 208*b,c* may be disposed in respective prongs of the booster manifold. Alternatively, a separate line (not shown) may be connected to the branches of the flow crosses 223*m,b* instead of the kill manifold. An upper end of the kill line 229*k* may be connected to an outlet of the annulus pump 30*a*. A lower end of the choke line 229*c* may have prongs connected to respective second branches of the flow crosses 223*m,b*. Shutoff valves 208*d,e* may be disposed in respective prongs of the choke line lower end.

A pressure sensor 235*a* may be connected to a second branch of the upper flow cross 223*u*. Pressure sensors 235*b,c* may be connected to the choke line prongs between respective shutoff valves 208*d,e* and respective flow cross second branches. Each pressure sensor 235*a-c* may be in data communication with the control pod 225. The lines 229*c,k* and umbilical 206 may extend between the MODU 201*m* and the PCA 201*p* by being fastened to brackets disposed along the riser 250. Each line 229*c,k* may be a flow conduit, such as coiled tubing. Each shutoff valve 208*a-e* may be automated and have a hydraulic actuator (not shown) operable by the control pod 225 via fluid communication with a respective umbilical conduit or the LMRP accumulators 211. Alternatively, the valve actuators may be electrical or pneumatic.

The fluid transport system 201*t* may include an upper marine riser package (UMRP) 251, the marine riser 250, and a return line 229*r*. The riser 250 may extend from the PCA 201*p* to the MODU 201*m* and may connect to the MODU via the UMRP 251. The UMRP 251 may include a riser compensator 240, a diverter 252, a flex joint 253, a slip (aka telescopic) joint 254, a tensioner 256, and an RCD 255. A lower end of the RCD 255 may be connected to an upper end of the riser 250, such as by a flanged connection. An auxiliary umbilical 212 may have hydraulic conduits and may provide fluid communication between an interface of the RCD 255 and the HPU of the PLC 25. The slip joint 254 may include an outer barrel connected to an upper end of the RCD 255, such as by a flanged connection, and an inner barrel connected to the flex joint 253, such as by a flanged connection. The outer barrel may also be connected to the tensioner 256, such as by a tensioner ring (not shown). The RCD 255 may be located adjacent the waterline 204*w* and may be submerged.

Alternatively, the RCD 255 may be located above the waterline 204*w* and/or along the UMRP 251 at any other location besides a lower end thereof. Alternatively, the RCD 255 may be located at an upper end of the UMRP 251 and the slip joint 254 and bracket connecting the UMRP to the rig 1*r* may be omitted or the slip joint may be locked instead of being omitted. Alternatively, the RCD 255 may be assembled as part of the riser 250 at any location therealong or as part of the PCA 1*p*.

The flex joint 253 may also connect to the diverter 252, such as by a flanged connection. The diverter 252 may also be connected to the rig floor 4, such as by a bracket. The slip joint 254 may be operable to extend and retract in response to heave of the MODU 201*m* relative to the riser 250 while the tensioner 256 may reel wire rope in response to the heave, thereby supporting the riser 250 from the MODU 201*m* while accommodating the heave. The flex joints 253, 228 may accommodate respective horizontal and/or rotational (aka pitch and roll) movement of the MODU 201*m* relative to the riser 250 and the riser relative to the PCA 201*p*. The riser 250 may have one or more buoyancy modules (not shown) disposed therealong to reduce load on the tensioner 256.

The riser compensator 240 may be employed to aid the PLC 25 in maintaining parity of the actual and target BHPs instead of or in addition to having to adjust the choke 23. The riser compensator 240 may include an accumulator 241, a gas source 242, a pressure regulator 243, a flow line, one or more shutoff valves 245, 248, and a pressure sensor 246.

The shutoff valve 245 may be automated and have a hydraulic actuator (not shown) operable by the PLC 25 via fluid communication with the HPU. The shutoff valve 245 may be connected to an inlet of the RCD 255. The flow line may be a flexible conduit, such as hose, and may also be connected to the accumulator 241 via a flow tee. The accumulator 241 may store only a volume of compressed gas, such as nitrogen. Alternatively, the accumulator may store both liquid and gas and may include a partition, such as a bladder or piston, for separating the liquid and gas. A liquid and gas interface 247 may be in the flow line. The shutoff valve 248 may be disposed in a vent line of the accumulator 241. The pressure regulator 243 may connect to the flow line via a branch of the tee. The pressure regulator 243 may be automated and have an adjuster operable by the PLC 25 via fluid communication with the HPU or electrical communication with the PLC. A set pressure of the regulator 243 may correspond to a set pressure of the choke 23 and both set pressures may be adjusted in tandem. The gas source 242 may also be connected to the pressure regulator 243.

The riser compensator 240 may be activated by opening the shutoff valve 245. During heaving, when the drill string 207 (and/or riser 250) moves downward, the volume of fluid displaced by the downward movement may flow through the shutoff valve 245 into the flow line, moving the liquid and gas interface 247 toward the accumulator 241 and accommodating the downward movement. The interface 247 may or may not move into the accumulator 241. When the drill string 207 (and/or riser 250) moves upward, the interface 247 may move along the flow line 244 away from the accumulator 241, thereby replacing the volume of fluid moved thereby.

The fluid handling system 201*f* may include the pumps 30*c,a,m*, the shale shaker 33, the flow meters 34*c,a,m,r*, the pressure sensors 35*c,a,m,r*, the choke 23, and the degassing spool 230. A lower end of the return line 229*r* may be connected to an outlet of the RCD 255 and an upper end of the return line 229*r* may be connected to a returns spool. An upper end of the choke line 229*r* may also be connected to the returns spool. The returns pressure sensor 35*r*, choke 23, and returns flow meter 34*r* may be assembled as part of the returns spool. A lower end of the standpipe may be connected to an outlet of the mud pump 30*d* and an upper end of a Kelly hose may be connected to an inlet of the top drive 5. The supply pressure sensor 35*d* and supply flow meter 34*d* may be assembled as part of a supply line (standpipe and Kelly hose).

The degassing spool 230 may include automated shutoff valves at each end, a mud-gas separator (MGS) 232, and a gas detector 231. A first end of the degassing spool may be connected to the returns spool between the returns flow meter 34*r* and the shaker 33 and a second end of the degasser spool may be connected to an inlet of the shaker. The gas detector 231 may include a probe having a membrane for sampling gas from the returns 130*r*, a gas chromatograph, and a carrier system for delivering the gas sample to the chromatograph. The MGS 231 may include an inlet and a liquid outlet assembled as part of the degassing spool and a gas outlet connected to a flare (not shown) or a gas storage vessel.

Figure 7D:
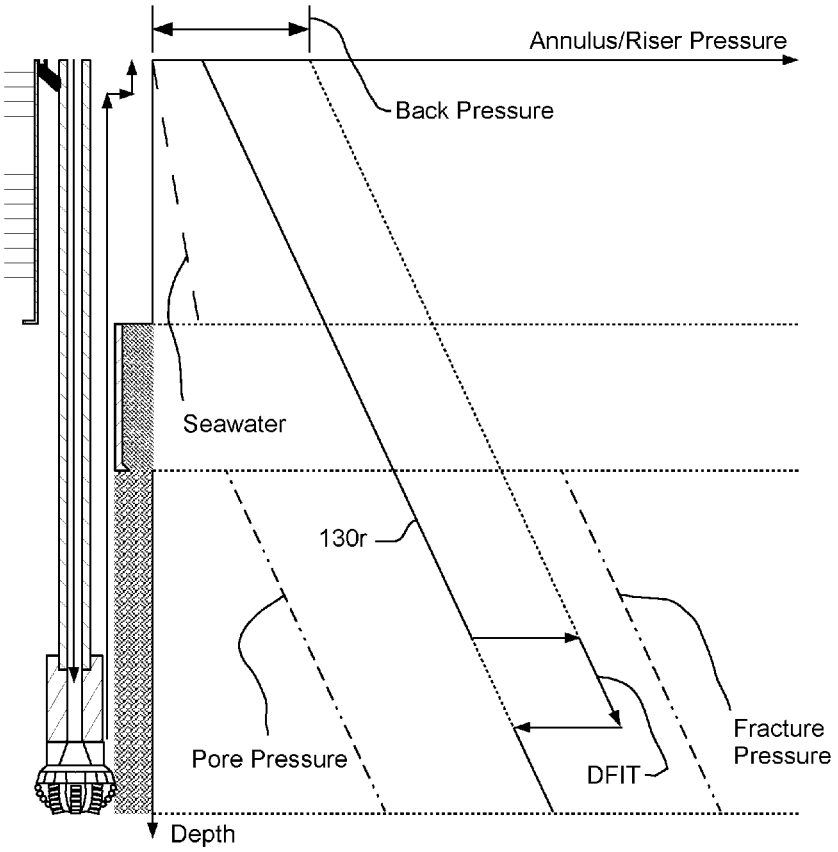
FIG. 7D illustrates a dynamic formation integrity test performed using the drilling system.

FIG. 7D illustrates a dynamic formation integrity test (DFIT) performed using the drilling system 201. During drilling of the lower formation 104*b*, the PLC 25 may periodically increase the BHP from the target BHP to a pressure corresponding to an expected pressure that will be exerted on the lower formation during the cementing operation. The PLC 25 may increase the BHP to the expected pressure by tightening the choke 23. The expected pressure may be slightly less than the fracture pressure of the lower formation 104*b*. The expected pressure may be maintained for a desired depth and/or period of time. Should the lower formation 104*b* withstand the expected pressure, then the cementing operation may proceed as planned. Should returns 130*r* leak into the formation during the DFIT, then the cementing operation may have to be modified, such as by adding returns pump 270 (or alternatives discussed below) or by modifying properties of the cement slurry 130*c* to decrease the expected pressure.

Figure 7E:
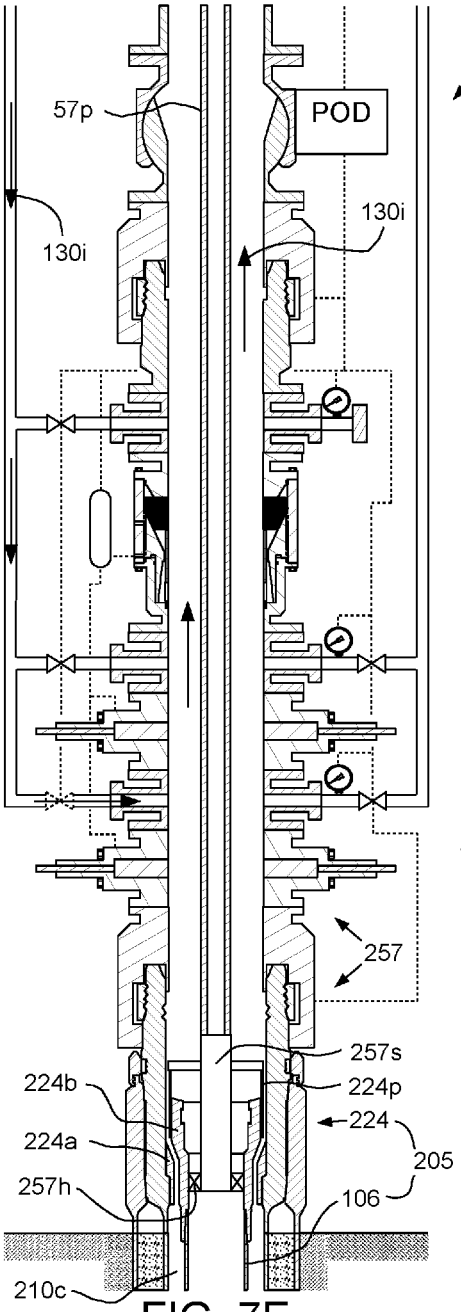
FIGS. 7E and 7F illustrate monitoring of cement curing of a subsea casing cementing operation conducted using the drilling system.
Figure 7F:
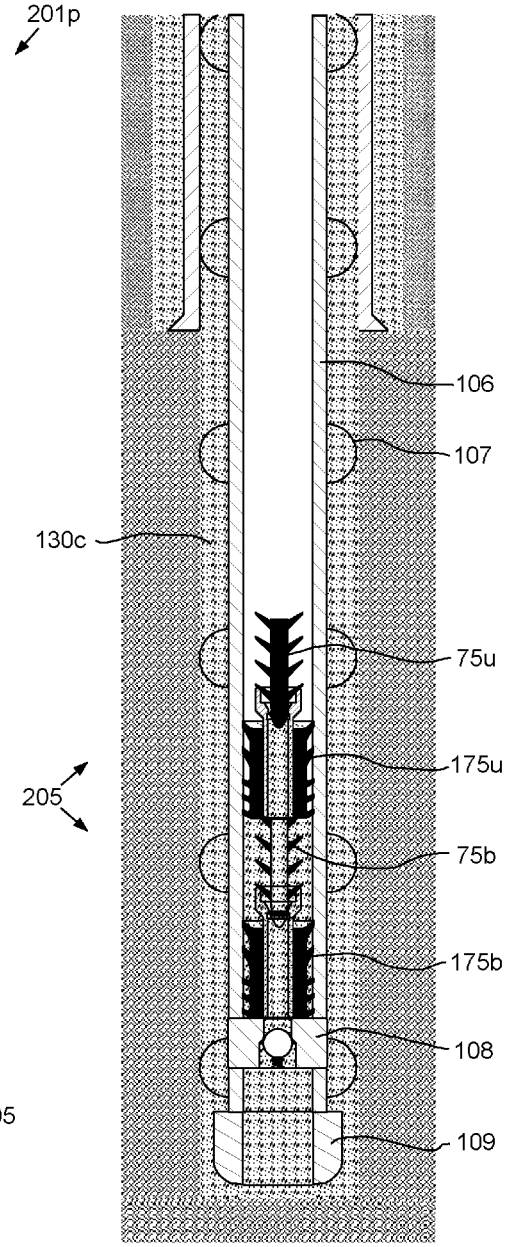

FIGS. 7E and 7F illustrate monitoring of cement curing of a subsea casing cementing operation conducted using the drilling system 201. Once the wellbore 200 has been drilled into the lower reservoir 104*b* to a desired depth, the drill string 207 may be retrieved from the wellbore 200 and an inner casing string 205 may be deployed into the wellbore 200. The inner casing string 205 may include the casing joints 106, the centralizers 107, the float collar 108, the guide shoe 109, and a casing hanger 224. The casing hanger 224 may include a body 224*b*, an anchor 224*a*, and a packoff 224*p*.

The inner casing string 205 may be deployed into the wellbore 200 using a workstring 257. The workstring 257 may include joints of tubulars, such as drill pipe 57*p*, connected together, such as by threaded connections, a seal head 257*h*, and a setting tool 257*s*. A top wiper 175*u* and a bottom wiper 175*b*, each similar to the liner wiper 175, may be connected to a bottom of the setting tool. The setting tool 257*s* may connect the inner casing string 205 to the workstring 257. The workstring 257 may also be connected to a subsea cementing head (not shown). The subsea cementing head may be similar to the liner cementing head 50 except that the subsea cementing head may include a top dart 75*u* and a bottom dart 75*b* for engaging the top wiper 175*u* and the bottom wiper 175*b*, respectively, and the swivels may or may not be omitted. The subsea cementing head may also be connected to the Kelly valve 11.

The anchor 224*a* may include a cam and one or more fasteners. The anchor cam may land on a shoulder formed in an inner surface of the wellhead housing. The wellhead housing may also have a locking profile (not shown) formed in an inner surface thereof for receiving the anchor fasteners. The anchor cam may be operable to extend the anchor fasteners into engagement with the wellhead locking profile, thereby longitudinally connecting the casing hanger to the wellhead 221. The anchor cam may be operated by articulation of the workstring 257, such as by setting weight on the anchor 224*a* or rotation of the workstring. The anchor 224*a* may further include flow passages formed therethrough for allowing flow of return fluid from the cementing operation.

The packoff 224*p* may be operable to radially expand into engagement with an inner surface of the wellhead housing, thereby isolating the casing-wellhead interface. The setting tool 257*s* may be operable to set the anchor 224*a* and packoff 224*p* independently. The packoff 224*p* may be set by further articulation of the workstring 257. Alternatively, the setting tool may be operated to set anchor and/or the packoff hydraulically as discussed above for the liner setting tool 57*s*. The setting tool 257*s* may be released from the casing hanger 224 by articulation of the workstring 257 or hydraulically.

To cement the inner casing string 205, conditioner 130*w* may be circulated by the cement pump 30*c* through the valve 59 or by the mud pump 30*m* via the top drive 12 to prepare for pumping of the cement slurry 130*c*. The anchor 224*a* may then be set and the setting tool 257*s* released from the casing hanger 22. The bottom dart 75*b* may be released from the subsea cementing head. Cement slurry 130*c* may be pumped from the mixer 36 into the subsea cementing head via the valve 59 by the cement pump 30*c*. The cement slurry 130*c* may flow into the launcher and be diverted past the upper dart via the diverter and bypass passages. The cement slurry 130*c* may propel the bottom dart 75*b* through the workstring bore.

Once the desired quantity of cement slurry 130*c* has been pumped, the top dart 75*u* may be released from the launcher by the PLC 25. Depending on the length of the inner casing 205 and the depth of the wellhead 221, the bottom dart 75*b* may land onto the bottom wiper 175*b* before or after pumping of the cement slurry 130*c* has finished. The displacement fluid 130*d* may be pumped into the subsea cementing head via the valve 59 by the cement pump 30*c*. The displacement fluid 130*d* may flow into the launcher and be forced behind the top dart 75*u*, thereby propelling the top dart into the workstring bore. Pumping of the displacement fluid 130*d* by the cement pump 30*c* may continue until residual cement in the discharge conduit has been purged. Pumping of the displacement fluid 130*d* may then be transferred to the mud pump 30*m* by closing the valve 59 and opening the Kelly valve 11.

The top dart 75*u* may be driven through the workstring bore by the displacement fluid 130*d* (while driving the combined bottom dart 75*b* and wiper 175*b* through the casing bore) until the top dart 75*u* lands onto the top wiper 175*u* and the bottom dart and wiper land onto the float collar 108. A diaphragm (not shown) of the bottom dart 75*b* may rupture and the cement slurry 130*c* may be driven through the float collar 108 and guide shoe 109 and into the annulus 210*c*. Pumping of the displacement fluid 130*d* may continue until the combined top dart 75*u* and wiper 175*u* land on the float collar 108. Landing of the combined top dart 75*u* and wiper 175*u* may increase pressure in the casing and workstring bore and be detected by the PLC 25 monitoring the standpipe pressure. Once landing has been detected, pumping of the displacement fluid 130*d* may be halted. Pressure in the workstring and casing bore may be bled. The float valve 108 may close, thereby preventing the cement slurry 130*c* from flowing back into the casing bore.

During the cementing operation, the PLC 25 may be programmed to operate the choke 23 so that the target bottomhole pressure (BHP) is maintained in the annulus 210*c* during the cementing operation and the PLC 25 may execute a real time simulation of the cementing operation in order to predict the actual BHP from measured data (as discussed above for the casing cementing operation). The PLC 25 may then compare the predicted BHP to the target BHP and adjust the choke 23 accordingly. The PLC 25 may also perform the mass balance and adjust the target accordingly. The PLC 25 may also determine the cement level in the annulus 210*c*.

Once the casing bore has been bled, the annulus pump 30*a* may be operated to pump indicator fluid 130*i* to the lower flow cross 223*b* via the kill line 229*k*. The indicator fluid 130*i* may flow radially across the wellhead 221 and exit the wellhead to the choke line 229*c*. As the packoff 224*p* has not been set, the indicator fluid path may be in fluid communication with the annulus 210*c*, thereby forming a tee having the annulus as a stagnant branch. The indicator fluid 130*i* may continue through the choke 23, return flow meter 34*r*, and shaker 33. Circulation of the indicator fluid 130*i* may be maintained during the curing period. As the indicator fluid 130*i* is being circulated, the PLC 25 may perform a mass balance between entry and exit of the indicator fluid into/from the wellhead 21 to monitor for formation fluid 130*f* entering the annulus 210*c* or cement slurry 130*c* entering the formation 104*b* using the flow meters 34*a,r*. The PLC 25 may tighten the choke 23 in response to detection of formation fluid 130*f* entering the annulus 210*c* and relax the choke 23 in response to cement slurry 130*c* entering the formation 104*b*.

The riser compensator 240 may be operated during the cementing and curing operation to negate the effect of heave on the mass balance. Alternatively, the PLC 25 may include one or more sensors (not shown) to adjust the mass balance during curing to account for heave, such as an accelerometer and/or an altimeter. Alternatively, the PLC 25 may be in data communication with the MODU's dynamic positioning system and/or tensioner and receive necessary heave data therefrom. The PLC 25 may also adjust the choke 23 to maintain parity of the actual and target BHPs during cementing and/or curing in response to heave of the MODU. Once curing is complete, the setting tool 257*s* may be operated to set the packoff 224*p*.

Alternatively, the packoff 224*p* may be set after the cementing operation (before curing) and the curing monitoring may be omitted. Alternatively, the packoff 224*p* may be set after the cementing operation (before curing) and the inner casing string 205 may include any of the cement sensors 161*a-f*, the data cable 163, and the wireless data coupling 162*i*. The outer wireless data coupling 162*o* may be disposed in the wellhead 221 and the wellhead may include a second wireless data coupling (not shown) connected to the outer coupling by lead wire which may interface with a corresponding second wireless data coupling disposed in the wellhead adapter 226*b* which may be in data communication with the pod 225 via a jumper. The PLC 25 may then receive measurements from the cement sensors 161*a-f* to monitor the curing (and cementing) operation.

Figure 8A:
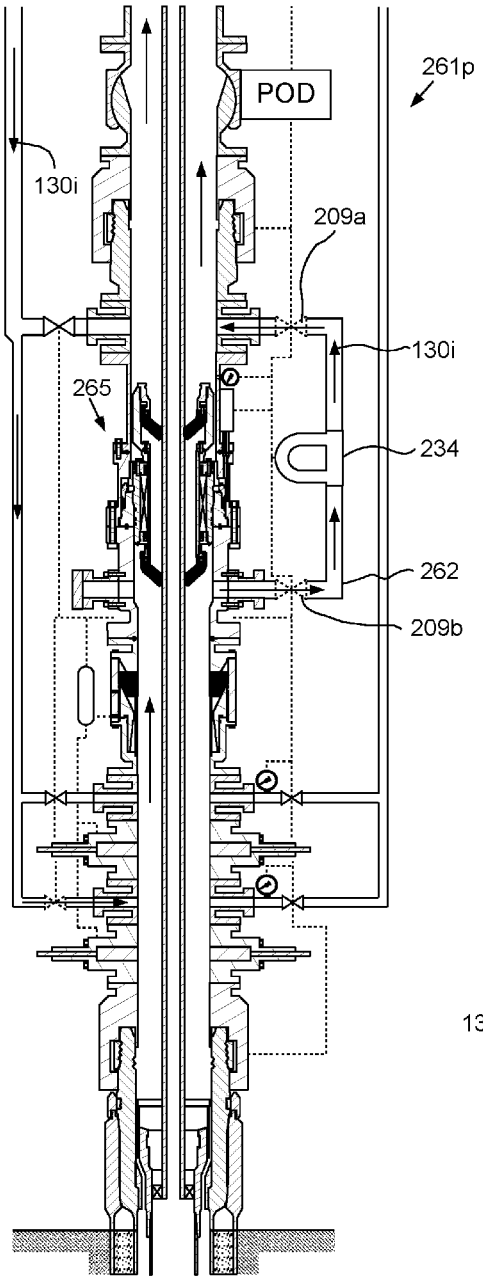
FIG. 8A illustrates monitoring of cement curing of a subsea casing cementing operation conducted using an second offshore drilling system, according to another embodiment of the present invention.

FIG. 8A illustrates monitoring of cement curing of a subsea casing cementing operation conducted using a second offshore drilling system, according to another embodiment of the present invention. The second drilling system may include the MODU 201*m*, the drilling rig 1*r*, the fluid handling system 201*f*, the fluid transport system 201*t*, and a pressure control assembly (PCA) 261*p*. The PCA 261*p* may include the wellhead adapter 226*b*, the flow crosses 223*u,m,b*, the blow out preventers (BOPs) 220*a,u,b*, the LMRP, the accumulators 211, the receiver 227, the choke line 229*c*, the kill line 229*k*, a second RCD 265, and a subsea flow meter 234.

Figure 8B:
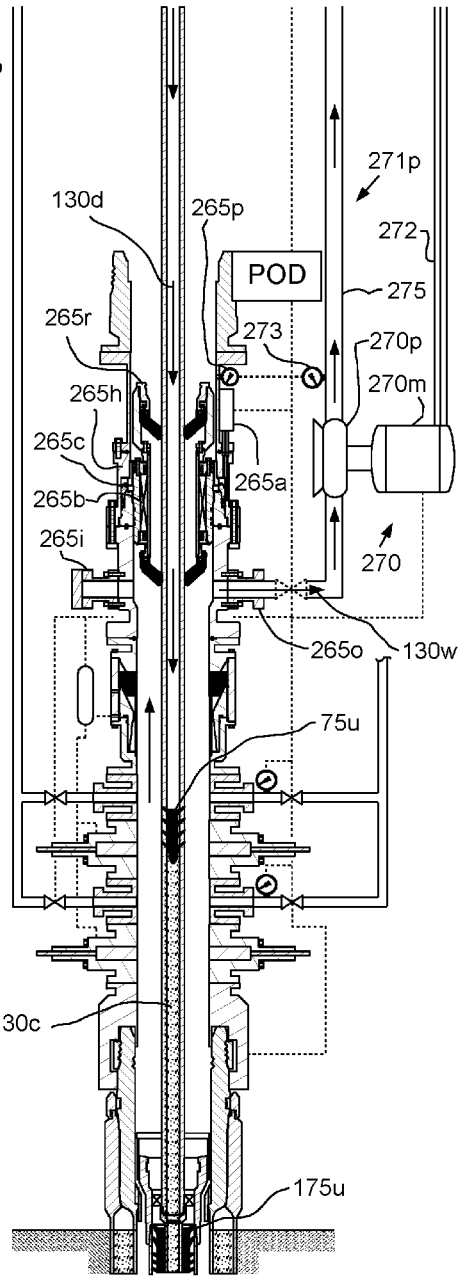
FIGS. 8B and 8C illustrate a subsea casing cementing operation conducted using a third offshore drilling system, according to another embodiment of the present invention.

The second RCD 265 may be similar to the RCD 255. Referring also to FIG. 8B, the second RCD 265 may include an outlet 265*o*, an interface 265*a*, housing 265*h*, a latch 265*c*, and a rider 265*r*. The housing 265*h* may be tubular and include one or more sections connected together, such as by flanged connections. The housing 265*h* may further include an upper flange connected to an upper housing section, such as by welding, and a lower flange connected to a lower housing section, such as by welding.

The latch 265*c* may include a hydraulic actuator, such as a piston, one or more fasteners, such as dogs, and a body. The latch body may be connected to the housing 265*h*, such as by a threaded connection. A piston chamber may be formed between the latch body and a mid housing section. The latch body may have ports formed through a wall thereof for receiving the respective dogs. The latch piston may be disposed in the chamber and may carry seals isolating an upper portion of the chamber from a lower portion of the chamber. A cam surface may be formed on an inner surface of the piston for radially displacing the dogs. Hydraulic ports (not shown) may be formed through the mid housing section and may provide fluid communication between the interface 265*a* and respective portions of the hydraulic chamber for selective operation of the latch piston.

A jumper may have hydraulic conduits and may provide fluid communication between the RCD interface 265*a* and the control pod 225.

The rider 265*r* may include a bearing assembly 265*b*, a housing seal assembly, one or more strippers, and a catch sleeve. The bearing assembly 265*b* may support the strippers from the sleeve such that the strippers may rotate relative to the housing 255*h* (and the sleeve). The bearing assembly 265*b* may include one or more radial bearings, one or more thrust bearings, and a self contained lubricant system. The lubricant system may include a reservoir having a lubricant, such as bearing oil, and a balance piston in communication with the return fluid 130*i,r,w* (depending on the current operation being performed) for maintaining oil pressure in the reservoir at a pressure equal to or slightly greater than the return fluid pressure. The bearing assembly 265*b* may be disposed between the strippers and be housed in and connected to the catch sleeve, such as by a threaded connection and/or fasteners.

The rider 265*r* may be selectively longitudinally connected to the housing 265*h* by engagement of the latch 265*c* with the catch sleeve. The housing seal assembly may include a body carrying one or more seals, such as o-rings, and a retainer. The retainer may be connected to the catch sleeve, such as by a threaded connection (not shown), and the seal body may be trapped between a shoulder of the sleeve and the retainer. The housing seals may isolate an annulus formed between the housing 265*h* and the rider 265*r*. The catch sleeve may be torsionally coupled to the housing 265*h*, such as by seal friction or mating anti-rotation profiles.

The upper stripper may include the gland and a seal. The gland may include one or more sections, such as a first section and a second section, connected, such as by a threaded connection. The upper stripper seal may be connected to the first section, such as by fasteners (not shown), such that the upper stripper seal is longitudinally and torsionally coupled thereto. The second section may be connected to a rotating mandrel of the bearing assembly, such as by a threaded connection, such that the gland is longitudinally and torsionally coupled thereto. The lower stripper may include a retainer and a seal. The lower stripper seal may be connected to the stripper retainer, such as by fasteners (not shown), such that the lower stripper seal is longitudinally and torsionally coupled thereto. The stripper retainer may be connected to the rotating mandrel, such as by a threaded connection, such that the retainer is longitudinally and torsionally coupled thereto.

Each stripper seal may be directional and oriented to seal against the drill pipe 57*p* in response to higher pressure in the wellhead 221 than the riser 250. Each stripper seal may have a conical shape for fluid pressure to act against a respective tapered surface thereof, thereby generating sealing pressure against the drill pipe 57*p*. Each stripper seal may have an inner diameter slightly less than a pipe diameter of the drill pipe 57*p* to form an interference fit therebetween. Each stripper seal may be made from a polymer, such as a thermoplastic, elastomer, or copolymer, flexible enough to accommodate and seal against threaded couplings of the drill pipe 57*p* having a larger tool joint diameter. The lower stripper seal may be exposed to the return fluid 130*i,r,w* to serve as the primary seal. The upper stripper seal may be idle as long as the lower stripper seal is functioning. Should the lower stripper seal fail, the returns 130*r* may leak therethrough and exert pressure on the upper stripper seal via an annular fluid passage formed between the bearing mandrel and the drill pipe 57*p*. The drill pipe 57*p* may be received through a bore of the rider 255*r* so that the stripper seals may engage the drill pipe. The stripper seals may provide a desired barrier in the riser 250 either when the drill pipe 57*p* is stationary or rotating.

Alternatively, the rider may be non-releasably connected to the housing. Alternatively, an active seal RCD may be used. The active seal RCD may include one or more bladders (not shown) instead of the stripper seals and may be inflated to seal against the drill pipe by injection of inflation fluid. The active seal RCD rider may also served as a hydraulic swivel to facilitate inflation of the bladders. Alternatively, the active seal RCD may include one or more packings operated by one or more pistons of the rider. Alternatively, a lubricated packer assembly may be used.

A lower end of the second RCD housing 265*h* may be connected to the annular BOP 220*a* and an upper end of the second RCD housing may be connected to the upper flow cross 223*u*, such as by flanged connections. A pressure sensor 265*p* may be connected to an upper housing section of the second RCD 265 above the rider 265*r*. The pressure sensor 265*p* may be in data communication with the control pod 225 and the second RCD latch piston may be in fluid communication with the control pod via the interface 265*a* of the second RCD 265.

A lower end of a subsea bypass spool 262 may be connected to the second RCD outlet 265*o* and an upper end of the spool may be connected to the upper flow cross 223*u*. The bypass spool 262 may have first 209*a* and second 209*b* shutoff valves and the subsea flow meter 234 assembled as a part thereof. Each shutoff valve 209*a,b,b* may be automated and have a hydraulic actuator (not shown) operable by the control pod 225 via fluid communication with a respective umbilical conduit or the LMRP accumulators 211. The subsea flow meter 234 may be a mass flow meter, such as a Coriolis flow meter, and may be in data communication with the PLC 25 via the pod 225 and the umbilical 206. Alternatively, a subsea volumetric flow meter may be used instead of the mass flow meter.

The return fluid 130*i,r,w* may flow through the annulus 210*c* to the wellhead 221. The return fluid 130*i,r,w* may continue from the wellhead 221 to the second RCD 265 via the BOPs 220*a,u,b*. The return fluid 130*i,r,w* may be diverted by the second RCD 265 into the subsea bypass spool 262 via the second RCD outlet 265*o*. The return fluid 130*i,r,w* may flow through the open second shutoff valve 209*b*, the subsea flow meter 234, and the first shutoff valve 209*a* to a branch of the upper flow cross 223*u*. The return fluid 130*i,r,w* may flow into the riser 250 via the upper flow cross 223*u*, the receiver 227, and the LMRP. The return fluid 130*i,r,w* may flow up the riser 250 to the first RCD 255. The return fluid 130*i,r,w* may be diverted by the first RCD 255 into the return line 229 via the first RCD outlet. The return fluid 130*i,r,w* may continue from the return line 29 and into the returns spool. The return fluid 130*i,r,w* may flow through the choke 36 and the returns flow meter 34*r* into the shale shaker 33.

During the drilling, cementing, and curing operation, the PLC 25 may rely on the subsea flow meter 234 instead of the surface flow meter 34*r* to perform BHP control and the mass balance. The surface flow meter 34*r* may be used as a backup to the subsea flow meter 234 should the subsea flow meter fail.

Figure 8C:
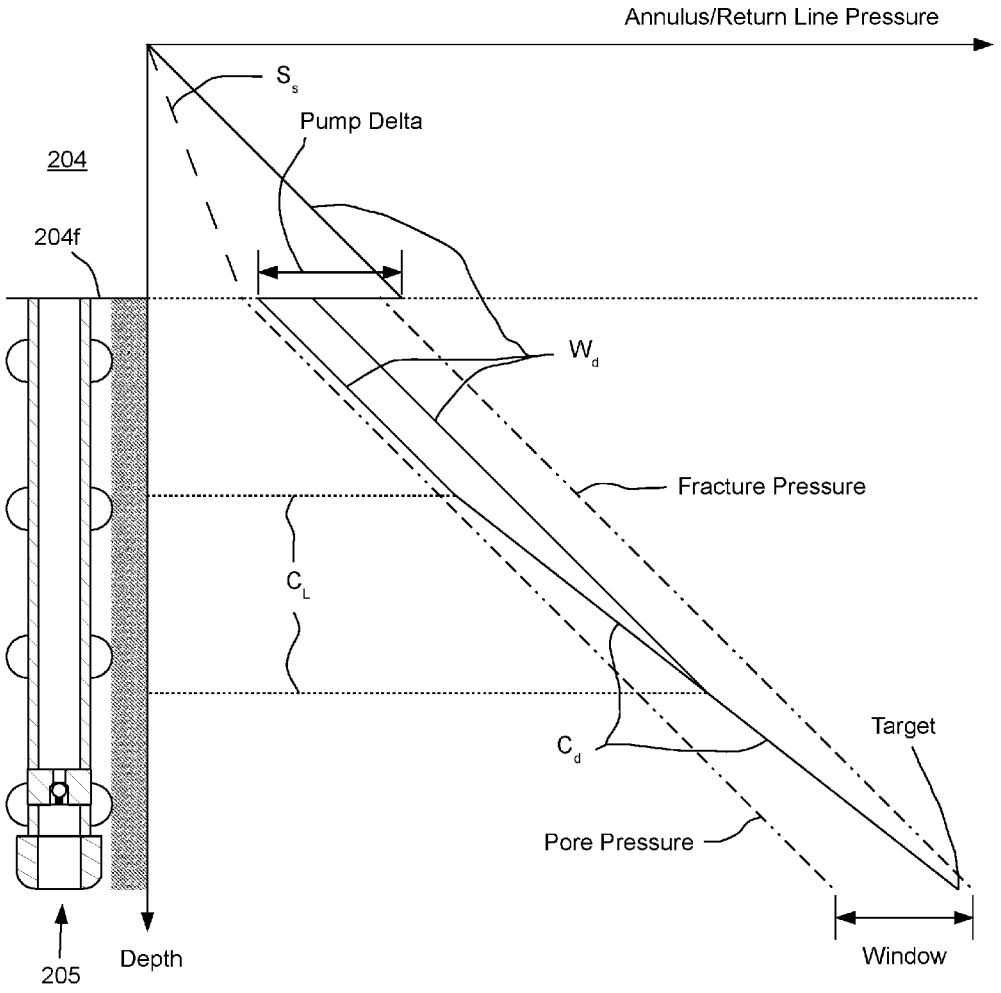

FIGS. 8B and 8C illustrate a subsea casing cementing operation conducted using a third offshore drilling system, according to another embodiment of the present invention. The third drilling system may include the MODU 201*m*, the drilling rig 1*r*, the fluid handling system 201*f*, and a riserless pressure control assembly (PCA) 271*p*. The riserless PCA 271*p* may include the wellhead adapter 226*b*, the flow crosses 223*m,b*, the blow out preventers (BOPs) 220*a,u,b*, the accumulators 211, the receiver 227, the kill line 229*k*, the choke line 229*c*, the second RCD 265, a return line 275, and a returns pump 270. The subsea wellbore 200 may also be drilled riserlessly using the third drilling system. The return line 275 may include a bypass spool (not shown) around the returns pump 270 such that the returns pump 270 may be selectively employed.

A lower end of the return line 275 may connect to the second RCD outlet 265*o* and an upper end of the return line 275 may connect to the returns spool. The returns pump 270 may be assembled as part of the returns line 275 and may include a submersible electric motor 270*m* and a centrifugal pump stage 270*p*. The returns pump 270 may further include a skid frame (not shown) having a mud mat for resting on the seafloor. A shaft of the motor 270*m* may be torsionally connected to a shaft of the pump stage 270*p* via a gearbox or directly (gearless). A lower end of a power cable 272 may be connected to the motor 270*m* and an upper end of the power cable 272 may be connected to a motor drive (not shown) onboard the MODU 201*m* and in data communication with the PLC 25. The motor drive may be a variable speed drive and the PLC 25 may control operation of the returns pump 270 by varying a rotational speed of the motor 270*m*. The returns line 275 may further include a discharge pressure sensor 273 in data communication with the control pod 225 and the PLC may monitor operation of the returns pump using the discharge pressure sensor and one of the pressure sensors 235*b,c* as an intake pressure sensor. Alternatively, the choke 23 may be used to control the returns pump 270.

Additionally, the pump stage 270*p* may be capable of accommodating cuttings or the returns pump 270 may further include a cuttings collector and/or pulverizer (not shown). Alternatively, the PLC 25 may determine intake and discharge pressures of the pump stage by monitoring power consumption of the motor 270*m*. Alternatively, the pump stage 270*p* may be positive displacement and/or the returns pump may include multiple stages. Alternatively, the motor 270*m* may be hydraulic or pneumatic. If hydraulic, the motor 270*m* may be driven by a power fluid, such as seawater or hydraulic oil.

Referring to FIG. 8C, an ECD $W_d$ of the conditioner 130*w* may correspond to a threshold pressure gradient of the lower formation, such as pore pressure gradient, fracture pressure gradient, or an average of the two gradients. However, due to the dual gradient effect caused by a substantially lower density $S_s$ of the sea 204, the conditioner 130*w* may otherwise fracture the lower formation 104*b* if not for operation of the returns pump 270 (Pump Delta). The returns pump 270 may compensate for the dual gradient effect effectively creating a corresponding dual gradient effect so that the conditioner 130*w* does not fracture the lower formation 104*b* during conditioning. A static density (only ECD shown) of the cement 130*c* may also correspond to the threshold pressure gradient.

As cement 130*c* flows into the annulus 210*c*, the actual BHP may begin to be influenced by the cement ECD $C_d$. The PLC 25 may anticipate the dual gradient effect in the predicted BHP and increase the rotational speed of the pump, thereby increasing the pump delta. The PLC 25 may continue to increase the pump speed (thereby increasing pump delta) as a level $C_L$ of cement 130*c* in the annulus 210*c* rises and the influence of the cement ECD $C_d$ on the BHP increases to maintain parity of the actual/predicted BHP with the target BHP. During the cementing operation, the PLC 25 may track the cement level $C_L$ in the annulus 210*c* and may also perform the mass balance and adjust the target accordingly, as discussed above.

Once pumping of cement 130*c* is completed, the casing bore may be bled, and the indicator fluid 130*i* may be supplied to the flow cross 223*b* via the kill line 225*k* for circulating across the wellhead 221 using the returns pump 270 to maintain parity between the actual and target BHPs while the PLC 25 monitors for fluid ingress/egress. Should the PLC 25 detect ingress, the PLC may reduce the speed of the returns pump 270 and should the PLC detect egress, the PLC may increase the speed of the pump. Should the PLC 25 detect severe ingress during cementing or curing, the PLC may shut-down and bypass and the returns pump 270.

Alternatively, the returns line 275 may be shut-in, and the indicator fluid 130*i* may be circulated across the wellhead 221 by operating the annulus pump 30*a* to pump the indicator fluid 130*i* into the flow cross 223*b* via the kill line 225*k*. The indicator fluid 130*i* may then return to the MODU 201*m* via the choke line 229*c*. Pressure control may be maintained over the curing cement 130*c* by the choke 23. Alternatively, the conditioner ECD may be less than the pore pressure gradient and the annulus pump 30*a* and choke 23 may be used to control the BHP during conditioning and then BHP control may be shifted to the returns pump 270 for/during the cementing.

Alternatively, a buoyant fluid, such as base oil or nitrogen, may be injected at the RCD inlet 265*i* instead of using the returns pump 270, thereby mixing with the return fluid 130*i,r,w* and forming a return mixture having a density substantially less than a density of the return fluid, such as a density corresponding to seawater. Alternatively, the returns pump 270 may be added to the bypass spool 262 in addition to or instead of the subsea flow meter 234. Alternatively, the subsea flow meter 234 may be used in the riserless PCA 271*p* instead of or in addition to the returns pump 270.

Figure 9F:
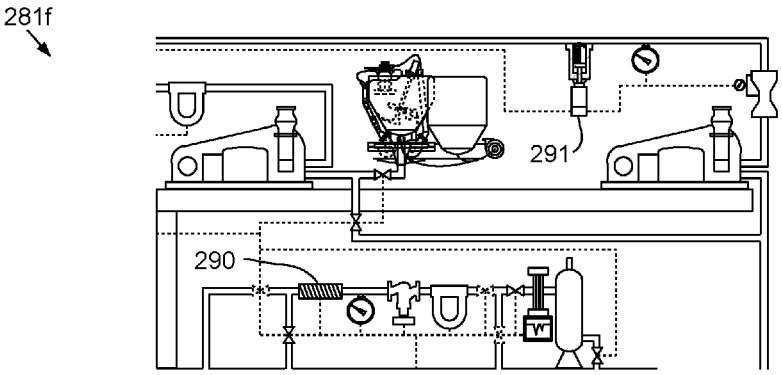
FIG. 9F illustrates the fluid handling system of the drilling system.
Figure 9A:
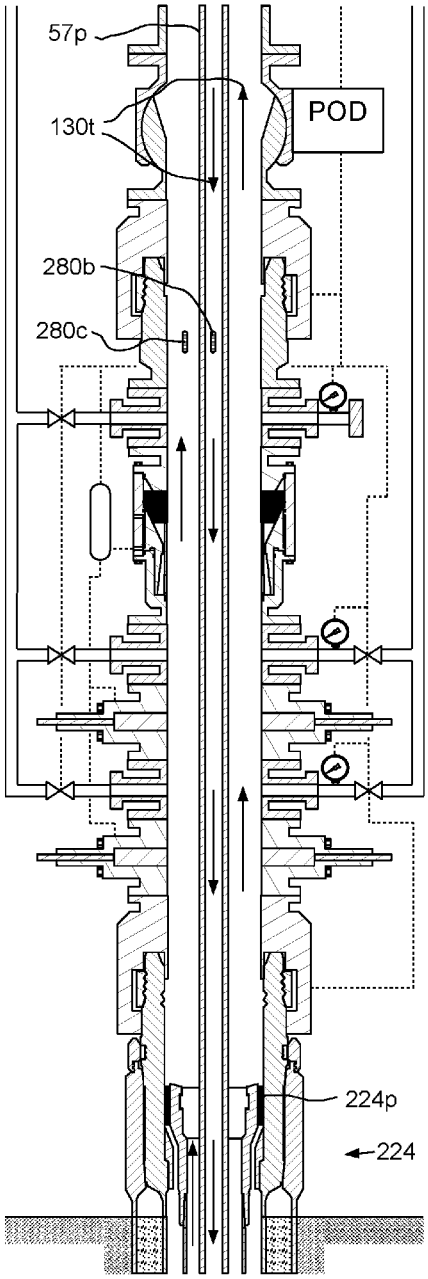
FIGS. 9A and 9B illustrate monitoring of cement curing of a subsea casing cementing operation conducted using a fourth offshore drilling system, according to another embodiment of the present invention.
Figure 9B:
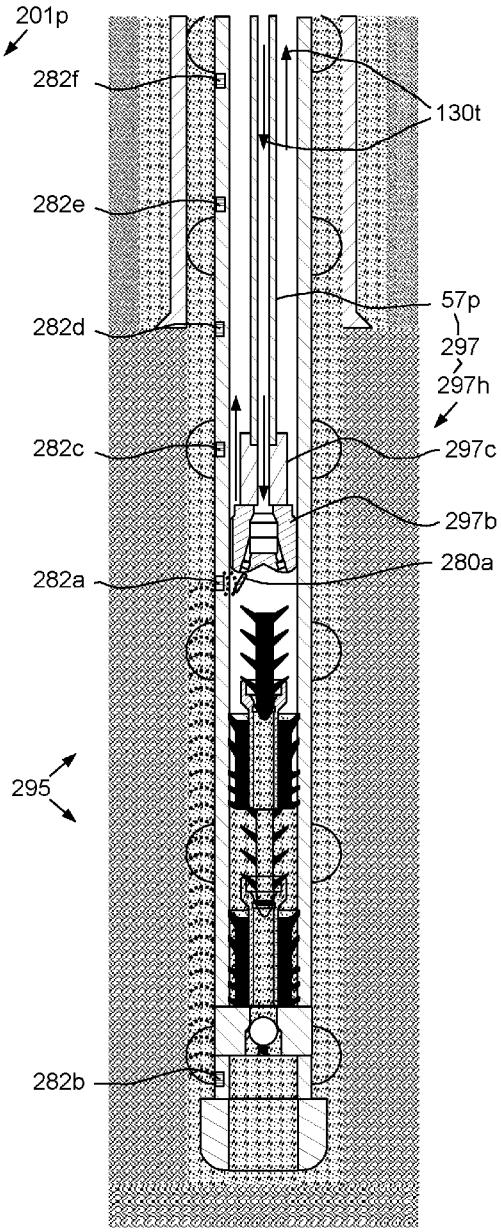
Figure 9C:
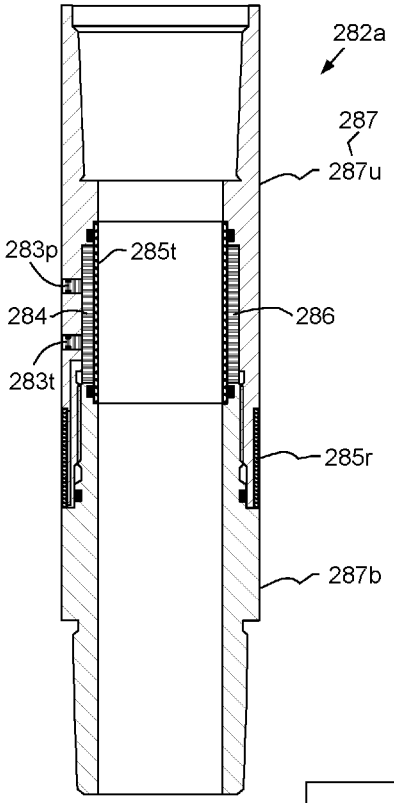
FIGS. 9C and 9E illustrate a wireless cement sensor sub of an alternative inner casing string being cemented.
Figure 9D:
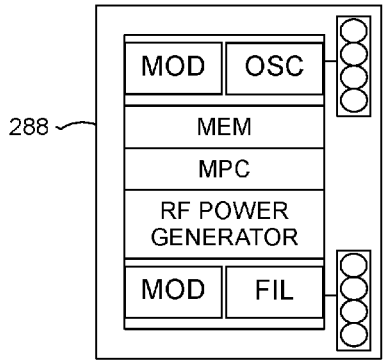
FIG. 9D illustrate a radio frequency identification (RFID) tag for communication with the sensor sub.
Figure 9E:
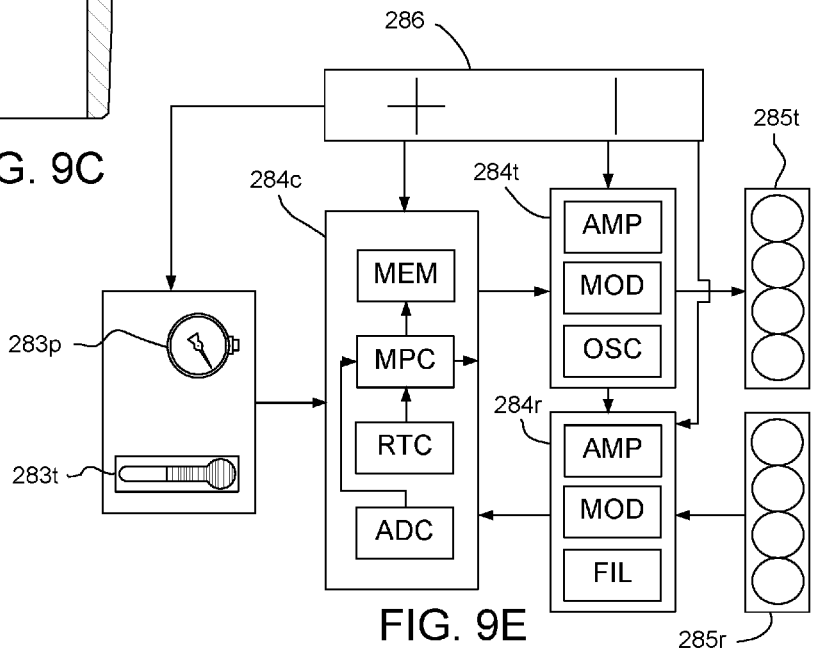

FIGS. 9A and 9B illustrate monitoring of cement curing of a subsea casing cementing operation conducted using a fourth offshore drilling system, according to another embodiment of the present invention. FIGS. 9C and 9E illustrate a wireless cement sensor sub 282*a* of an alternative inner casing string 295 being cemented. FIG. 9D illustrates a radio frequency identification (RFID) tag 280*a-c* for communication with the sensor sub 282*a*. FIG. 9F illustrates the fluid handling system 281*f* of the drilling system. The fourth drilling system may include the MODU 201*m*, the drilling rig 1*r*, the fluid handling system 281*f*, the fluid transport system 201*t*, and the pressure control assembly (PCA) 201*p*.

Once the wellbore 200 has been drilled into the lower reservoir 104*b* to the desired depth, the drill string 207 may be retrieved from the wellbore 200 and the inner casing string 295 may be deployed into the wellbore 200 using the workstring 257. The inner casing string 295 may include the casing joints 106, the centralizers 107, the float collar 108, the guide shoe 109, the casing hanger 224, and one or more wireless cement sensor subs 282*a-f*. A bottom sensor sub 282*b* may be assembled adjacent to the guide shoe 109 and/or the float collar 108. The rest of the sensor subs 282*a,c-f* may be spaced along a portion of the casing string 295 above the top dart 75*u*.

Each sensor sub 282*a-f* may include a housing 287, one or more cement sensors 283*p,t*, an electronics package 284, one or more antennas 285*r,t*, and a power source. The cement sensors 283*p,t* may include a pressure sensor 283*p* and/or temperature sensor 283*t*. Respective components of each sensor sub 282*a-f* may be in electrical communication with each other by leads or a bus. The power source may be a battery 286 or capacitor (not shown). The antennas 285*r,t* may include an outer antenna 285*r* and an inner antenna 285*t*. The bottom sensor sub 282*b* may not need the inner antenna 285*t* and the sensor subs 282*c-f* may not need the outer antenna 285*r*.

The housing 287 may include two or more tubular sections 287*u,b* connected to each other, such as by threaded connections. The housing 287 may have couplings, such as a threaded couplings, formed at a top and bottom thereof for connection to other component of the casing string 295. The housing 287 may have a pocket formed between the sections 287*u,b* thereof for receiving the electronics package 284, the battery 286, and the inner antenna 285*t*. To avoid interference with the antennas 285*r,t*, the housing 287 may be made from a diamagnetic or paramagnetic metal or alloy, such as austenitic stainless steel or aluminum. The housing 287 may have one or more radial ports formed through a wall thereof for receiving the respective sensors 283*p,t* such that the sensors are in fluid communication with the annulus 210*c*.

The electronics package 284 may include a control circuit 284*c*, a transmitter circuit 284*t*, and a receiver circuit 284*r*. The control circuit 284*c* may include a microprocessor controller (MPC), a data recorder (MEM), a clock (RTC), and an analog-digital converter (ADC). The data recorder may be a solid state drive. The transmitter circuit 284*t* may include an amplifier (AMP), a modulator (MOD), and an oscillator (OSC). The receiver circuit 284*r* may include the amplifier (AMP), a demodulator (MOD), and a filter (FIL). Alternatively, the transmitter 284*t* and receiver 284*r* circuits may be combined into a transceiver circuit.

Once the casing string 295 has been deployed, the sensor subs 282*a,c-f* may commence operation. Raw signals from the respective sensors 283*p,t* may be received by the respective converter, converted, and supplied to the controller. The controller may process the converted signals to determine the respective parameters, time stamp and address stamp the parameters, and send the processed data to the respective recorder for storage during tag latency. The controller may also multiplex the processed data and supply the multiplexed data to the respective transmitter 284*t*. The transmitter 284*t* may then condition the multiplexed data and supply the conditioned signal to the antenna 285*t* for electromagnetic transmission, such as at radio frequency. Each sensor sub 282*c-f* may transmit current parameters and some past parameters corresponding to a data capacity of a communication window between the sensor subs and the tags 280*a-c*. Since the bottom sensor sub 282*b* is inaccessible to the tags 280*a-c* due to the top dart 75*u* and the top wiper 175*u*, the bottom sensor sub may transmit its data to the sensor sub 282*a* via its transmitter circuit and outer antenna and the sensor sub 282*a* may received the bottom data via its outer antenna 285*r* and receiver circuit 284*r*. The sensor sub 282*a* may then transmit its data and the bottom data for receipt by the tags 280*a-c*.

Cementing of the inner casing string 295 may be accomplished in the same fashion as cementing of the inner casing string 205. Instead of keeping the workstring 257 deployed and the packoff 224*p* unset for the circulation of the indicator fluid 130*i* during curing, the packoff may immediately be set after pumping the cement slurry 130*c*. The workstring 257 may be retrieved to the MODU 201*m*. A drill string 297 may then be deployed to a depth adjacent the top dart 75*u*. The drill string 297 may include a bottomhole assembly (BHA) 297*h* and joints of the drill pipe 57*p* connected together, such as by threaded couplings. The BHA 297*h* may be connected to the drill pipe 57*p*, such as by a threaded connection, and include a drill bit 297*b* and one or more drill collars 297*c* connected thereto, such as by a threaded connection.

The fluid handling system 281*f* may include the pumps 30*c,a,m*, the shale shaker 33, the flow meters 34*c,a,m,r*, the pressure sensors 35*c,a,m,r*, the choke 23, the degassing spool 230, a tag reader 290, and a tag launcher 291. The tag launcher 291 may be assembled as part of the drilling fluid supply line. The tag launcher 291 may include a housing, a plunger, an actuator, and a magazine having a plurality of the RFID tags 280*a-c* loaded therein. A chambered RFID tag may be disposed in the plunger for selective release and pumping downhole to communicate with the sensor subs 282*a,c-f*. The plunger may be movable relative to the housing between a capture position and a release position. The plunger may be moved between the positions by the actuator. The actuator may be hydraulic, such as a piston and cylinder assembly and may be in communication with the PLC HPU. Alternatively, the actuator may be electric or pneumatic. Alternatively, the actuator may be manual, such as a handwheel.

Each RFD tag 280*a-c* may be a wireless identification and sensing platform (WISP) RFID tag. Each tag 280*a-c* may include an electronics package and one or more antennas housed in an encapsulation 288. Respective components of each tag 280*a-c* may be in electrical communication with each other by leads or a bus. The electronics package may include a control circuit, a transmitter circuit, and a receiver circuit. The control circuit may include a microcontroller (MCU), the data recorder (MEM), and a RF power generator. Alternatively, each tag 280*a-c* may have a battery instead of the RF power generator.

Once the drill string 295 has been deployed, the PLC 25 may launch the chambered tag by operating the HPU to supply hydraulic fluid to the launcher actuator. The actuator may then move the plunger to the release position (not shown). The carrier and chambered tag may then move into supply line. Transport fluid 130*t* discharged by the mud pump 30*m* may then carry the chambered tag from the launcher 291 and into the drill string 297 via the top drive 12 and Kelly valve 11. Once the chambered tag has been launched, the actuator may move the plunger back to the capture position and the plunger may load another tag from the magazine during the movement. The PLC 25 may launch tags 280*a-c* at a desired frequency.

Once the tag 280*a* has been circulated through the drill string 297, the tag may exit the drill bit 297*b* in proximity to the sensor sub 282*a*. The tag 280*a* may receive the data signal transmitted by the sensor sub 282*a*, convert the signal to electricity, filter, demodulate, and record the parameters. As the tag 280*a* travels up the annulus, the tag 280*a* may communicate with the other sensor subs 282*c-f* and record the data therefrom. The tag 280*a* may continue through the wellhead 221, the PCA 201*p*, and the riser 250 to the RCD 255. The tag 280*a* may be diverted by the RCD 255 to the returns line 229*r*. The tag 280*a* may continue from the returns line 229*r* to the tag reader 290.

The tag reader 290 may be assembled as part of the returns spool. The tag reader may include a housing, a transmitter circuit, a receiver circuit, a transmitter antenna, and a receiver antenna. The housing may be tubular and have flanged ends for connection to other members of the returns spool and/or the returns line 229*r*. The transmitter and receiver circuits may be similar to those of the sensor sub 282*a*. Alternatively, the tag reader 290 may include a combined transceiver circuit and/or a combined transceiver antenna. The tag reader 290 may transmit an instruction signal to the tag 280*a* to transmit the stored data thereof. The tag 280*a* may then transmit the data to the tag reader 290. The tag reader 290 may be sized to have a communications window such that the cumulative data received from the sensor subs 282*a-f* may be communicated while the tag 280*a* is flowing through the tag reader 290. The tag reader 290 may then relay the cumulative data to the PLC 25. The PLC 25 may then monitor the curing of the cement 130*c* and/or display the data for an operator to do so. The tags 280*a-c* may be recovered from the shale shaker 33 and reused or may be discarded. The circulation of tags 280*a-c* may continue during curing of the cement 130*c* until completion.

Alternatively, the tags 280*a-c* may be recovered from the shale shaker 33 and physically transported to a standalone tag reader. The tags 280*a-c* may include a magnetic core to facilitate recovery from the shale shaker. Alternatively, a solids separator having a tag reader may be used instead of the shale shaker 33. A vacuum conveyor separator (not shown) may be suitable for having a tag reader positioned over the filter belt to read the tag as it separated from the transport fluid 130*t*. Alternatively, the tag reader 290 may be located subsea in the PCA 201*p* or the riserless PCA 271*p* and may relay the data to the PCA via the umbilical 206. Alternatively, the tag reader 290 may be located in the bypass spool 262 of the PCA 261*p*.

Once the cement 130*c* has cured, the drill string 297 may be operated to drill out the darts 75*u,b*, wipers 175*u,b*, collar 108 and shoe 109 in preparation for a completion operation or to further extend the wellbore 200 into the lower formation 104*b* or another formation adjacent the lower formation.

Figures 10A, 10B, 10C:
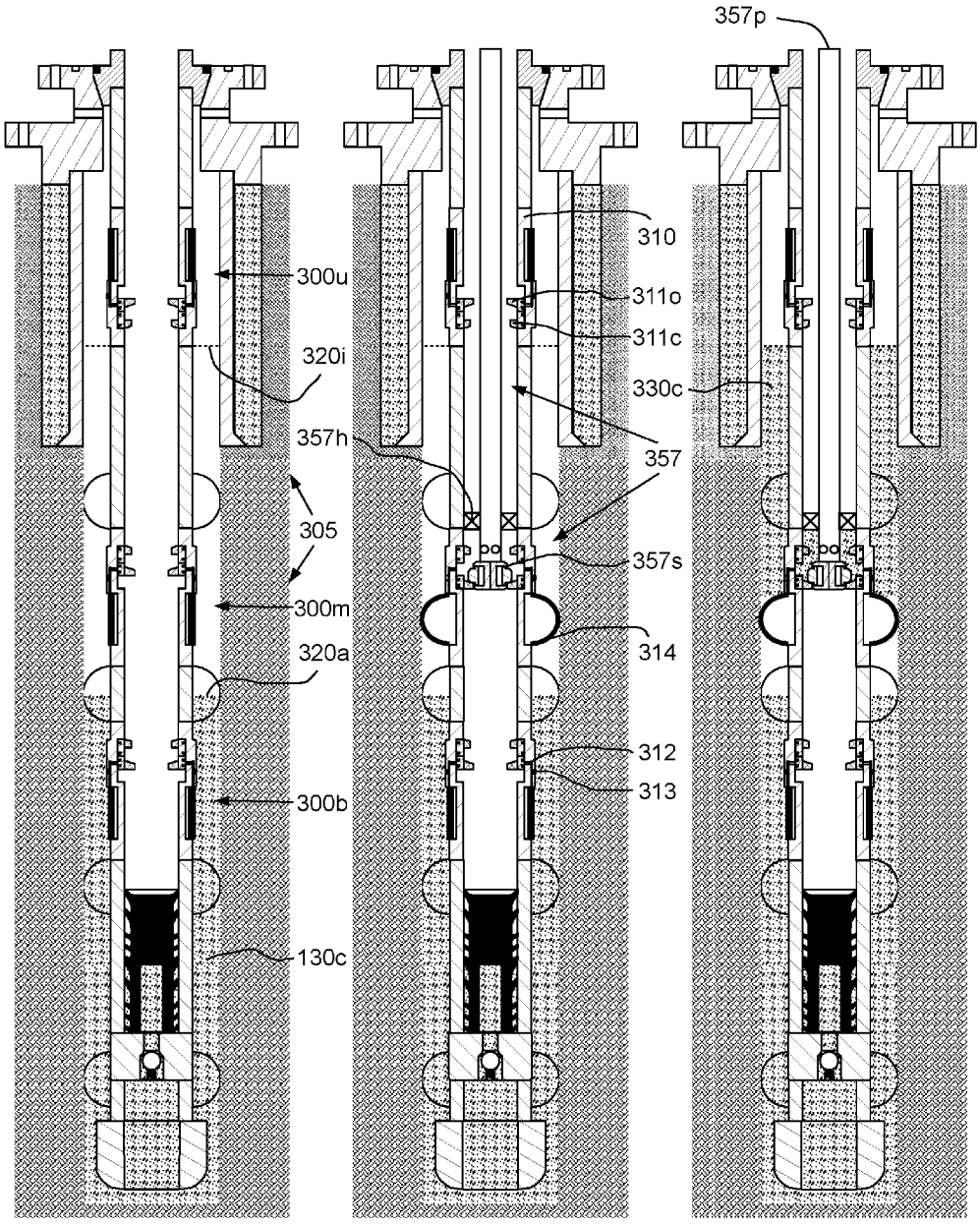
FIGS. 10A-10C illustrate a remedial cementing operation being performed using an alternative casing string, according to another embodiment of the present invention.

FIGS. 10A-10C illustrate a remedial cementing operation being performed using an alternative casing string 305, according to another embodiment of the present invention. The casing string 305 may be similar to the casing string 105, except for the addition of one or more stage collars 300*u,m,b*. Alternatively, the liner string 155 and/or the subsea casing strings 205, 295 may be modified to include the stage collars 300*u,m,b*. Each stage collar 300*u,m,b* may include a housing 310, an opener 311*o*, a closer 311*c*, a flow passage 312, a closure member, such as rupture disk 313, and an expandable seal, such as a bladder 314. The flow passage 312 may be formed in a wall of the housing 310. The flow passage 312 may extend from an inlet in selective fluid communication with a bore of the housing 310 to an inflation chamber of the bladder 314 and have an outlet branch in selective fluid communication with the annulus 110. The rupture disk 313 may be configured to operate at a set pressure corresponding to an inflation pressure of the bladder 314.

The stage collars 300*u,m,b* may be disposed along the casing string 305, such as an upper collar 300*u* located proximate to the casing hanger, a lower collar 300*b* located proximate to the float collar, and a mid collar 300*m* located between the upper and lower collars. The mid 300*m* and lower 300*b* stage collars may be oriented for a remedial cementing operation and the upper stage collar 300*u* may be oriented for a sealant squeezing operation (i.e., upside down relative to the mid and lower collars).

The stage collars 300*u,m,b* may be selectively operated in the event that the cementing and curing operation fails to produce an acceptable result. As shown, the final cement level 320*a* is substantially below the intended final cement level 320*i*, thereby forming a void in the annulus 110. The void may be due to cement slurry 130*c* egress into the lower formation 104*b* (see FIGS. 3D and 3G). Although failing, the PLC 25 may at least have determined the actual final cement level 320*a* and indicated that the cured cement 130*c* is unacceptable. The PLC 25 may also determine a quantity of remedial cement 330*c* necessary to fill the void. After curing of the cement slurry 130*c*, a workstring 357 may be deployed into the wellbore. The workstring 357 may include a shifting tool 357*s*, a seal head 357*h*, and a tubular string, such as coiled tubing 357*p* or drill pipe (not shown). Alternatively, the stage collars 300*u,m,b* may be operated by slick line or wire line. Alternatively, for the liner 155 and subsea casings 205, 295, the respective drill/workstrings 57, 257, 297 may include the shifting tool so that the remedial cementing operation may be performed without tripping.

The workstring 357 may be deployed until the shifting tool 357*s* is adjacent to the mid stage collar 300*m* as the lower stage collar 300*u* may be rendered inoperable by encasement in the cured cement 130*c*. The shifting tool 357*s* may be extended to engage a profile of the mid closer 311*o*. The shifting tool 357*s* may then longitudinally move the mid closer 3110 to an open position, thereby exposing the passage inlet. Inflation fluid (not shown), such as the conditioner 130*w*, may be pumped through the workstring 357 and may be discharged through ports of the shifting tool 357*s* into the mid passage inlet and along the mid passage 312 to the bladder chamber, thereby inflating the bladder 314. Once the bladder 314 has inflated, the rupture disk 313 may fracture thereby opening the outlet port. The inflation fluid may continue to be pumped until fully circulated through an open portion of the annulus 110. Once circulated, the remedial cement 330*c* may be pumped through the workstring 357 and into the annulus 110 via the mid stage collar 300*m*. The remedial cement 330*c* may be pumped until a level of the remedial cement reaches the intended cement level 320*i*. Once the remedial cement 330*c* has been pumped, the shifting tool 357*s* may be operated to engage the closer 311*c* and move the closer longitudinally (not shown), thereby closing the mid passage inlet to prevent backflow of the remedial cement slurry 330*c*.

During the remedial cementing operation, the PLC 25 may monitor and control conditioning and pumping of remedial cement slurry 330*c* as discussed above for the primary cementing operation. The PLC 25 may also monitor and control curing, as discussed above. Alternatively, the remedial cement slurry may be used to inflate the bladder, thereby obviating the conditioning step.

Figures 11A, 11B, 11C:
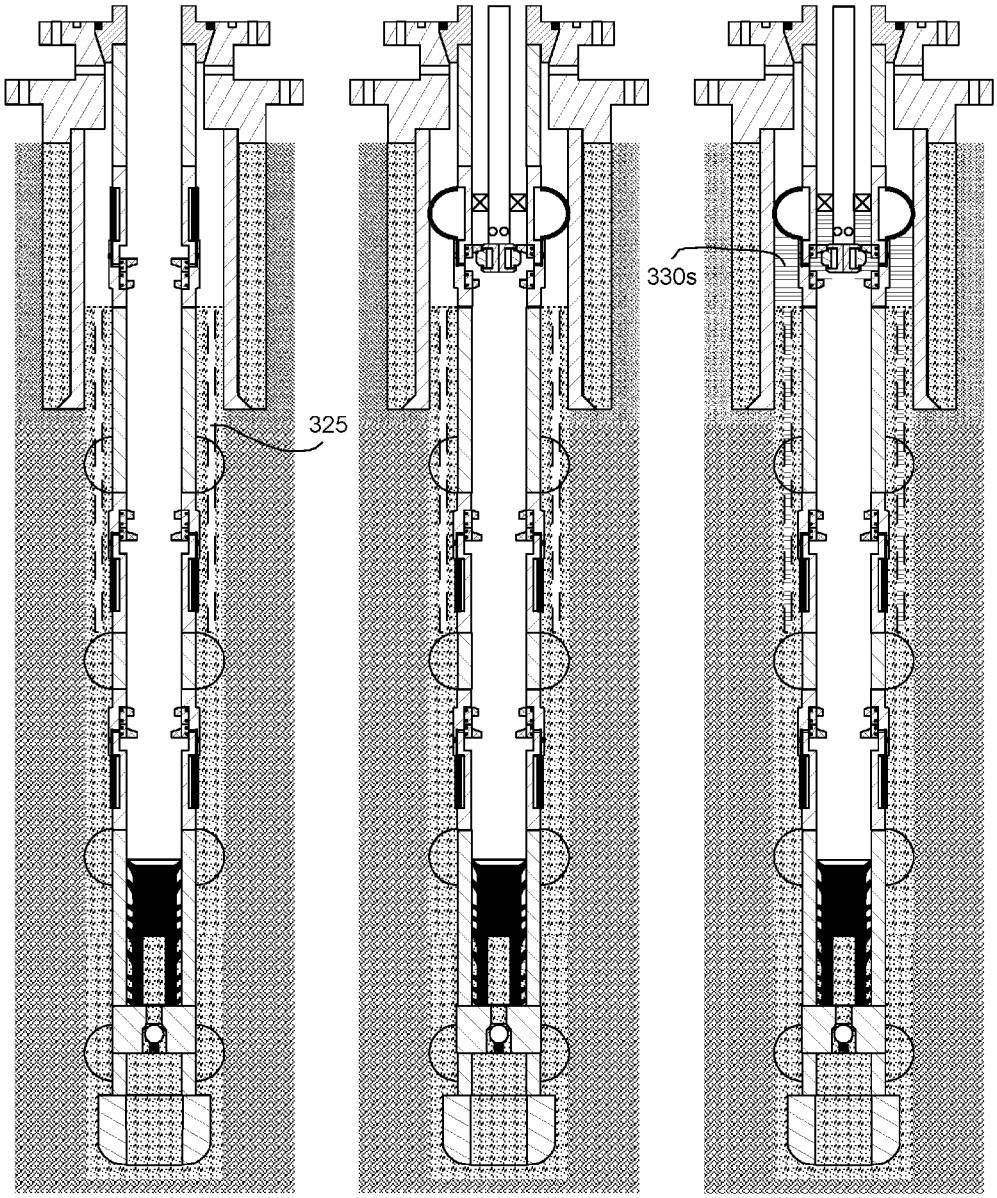
FIGS. 11A-11C illustrate a remedial squeeze operation being performed using the alternative casing string, according to another embodiment of the present invention.

FIGS. 11A-11C illustrate a remedial squeeze operation being performed using the alternative casing string 305, according to another embodiment of the present invention. As shown, the cured cement 130*c* has channels 325 formed therein. The channel formation may be due to formation fluid 130*f* infiltration from the lower formation 104*b* (see FIGS. 3C and 3F). Although failing, the PLC 25 may at least have determined the infiltration and indicated that the cured cement 130*c* is unacceptable. The PLC 25 may also determine the quantity of sealant 330*s* necessary to fill the channels 325.

After curing of the cement slurry 130*c*, the workstring 357 may be deployed into the wellbore 100. The workstring 357 may be deployed until the shifting tool 357*s* is adjacent to the upper stage collar 300*u*. The shifting tool 357*s* may be operated to open the upper stage collar 300*u*. The sealant 330*s* may be pumped through the workstring 357, thereby inflating the upper bladder 314 and opening the outlet. The sealant 330*s* may continue to be pumped into the annulus 110 via the upper stage collar 300*u* until the channeled portion of the cement 130*c* has been impregnated by the sealant 330*s*. The upper stage collar 300*u* may then be closed and the sealant 300*s* may cure (polymerize), thereby filling the channels 325.

The sealant 330*s* may be pumped as a liquid mixture, such as a solution. The solution may include a monomer, such as an ester, a diluent, such as water or seawater and/or alcohol, and a catalyst, such as a peroxide or persulfate. Alternatively, the sealant may be pumped as a slurry, such as grout or mortar.

Additionally, for any of the embodiments discussed above, the PLC 25 may detect and adjust the choke for any transient effects, such as landing of the bottom wiper (or combination dart and wiper) onto the float collar or landing of the bottom dart onto the bottom wiper.

Additionally, for any of the embodiments discussed above, the PLC 25 may operate the mass balance and choke control during deployment of the casings or liner into the wellbore. For the subsea casing and liner embodiments, the PLC 25 may further operate the mass balance and choke control during retrieval of the workstring to the drilling rig (including washing of the excess cement for the liner embodiment).

Additionally, for any of the embodiments discussed above, after drilling the wellbore and before removing the drill string, a balanced pill (not shown), such as a quantity of heavy mud, may be pumped in (aka spotted) before the drilling system is configured for the cementing operation. The pill may then be circulated out while deploying the liner/casing into the wellbore. A second pill may then be spotted after curing for the casing operations or after setting the packoff for the liner operation.

Additionally, for any of the embodiments discussed above, after curing of the cement, an integrity test may be performed. For the casing embodiments, the annulus may pressurized using the annulus pump and then the annulus may be shut-in and the pressure monitored. For the liner embodiment, the workstring may be deployed with a packer, the packer set to isolate the liner, and the liner may be pressurized and the pressure monitored.

Additionally, any of the embodiments discussed above may be used to during a plugging and abandonment operation to form cement plugs in a bore of a casing string or to cement an annulus of a casing string after the annulus has been opened using a section mill.

While the foregoing is directed to embodiments of the present invention, other and further embodiments of the invention may be devised without departing from the basic scope thereof, and the scope thereof is determined by the claims that follow.

The invention claimed is:

1. A method for operating a wellbore, comprising:

performing a drilling operation by injecting fluid to the wellbore having a tubular string disposed therein to circulate the fluid in a path including a bore of the tubular string and an annulus between the tubular string and a wall of the wellbore, and while performing the drilling operation:

drilling through a formation while a bottomhole pressure is at a target bottomhole pressure;

increasing the bottom hole pressure from the target bottomhole pressure to an expected pressure while drilling through the formation, wherein the expected pressure is a pressure expected during cementing of the formation exposed to the wellbore;

measuring a difference between an injection flow rate and a return flow rate in the path to detect leak and determine whether the formation withstands the expected pressure; and returning the bottomhole pressure to the target bottomhole pressure after maintaining the bottomhole pressure at the expected pressure while drilling through a depth or drilling for a period of time.

2. The method of claim 1, wherein the expected pressure is greater than or equal to a bore pressure and less than a fracture pressure of the formation exposed to the wellbore.

3. The method of claim 1, wherein the tubular string is a drill string having a drill bit, and performing the drilling operation further comprises rotating the drill bit.

4. The method of claim 3, wherein increasing the bottomhole pressure is performed periodically.

5. The method of claim 1, wherein increasing the bottomhole pressure comprises choking a return flow of the fluid.

6. The method of claim 1, further comprising maintaining the expected pressure for a desired period of time.

7. The method of claim 1, wherein the fluid is injected into the bore of the tubular string and returned through the annulus between the tubular string and the wall of the wellbore.

8. The method of claim 1, wherein the fluid is injected into the annulus between the tubular string and the wall of the wellbore and returned through the bore of the tubular string.

9. The method of claim 1, wherein the wellbore is a subsea wellbore.

10. The method of claim 1, further comprising:

reducing the expected pressure when the return flow rate is less than the injection flow rate; and modifying parameters for cementing operation according to the reduced expected pressure.

11. A method for operating a wellbore, comprising:

performing a drilling operation by injecting fluid to the wellbore having a tubular string disposed therein to circulate the fluid in a path including a bore of the tubular string and an annulus between the tubular string and a wall of the wellbore, and while performing the drilling operation:

drilling through a formation while a bottomhole pressure is at a target bottomhole pressure;

increasing the bottom hole pressure from the target bottomhole pressure to an expected pressure while drilling through the formation, wherein the expected pressure is a pressure expected during cementing of the formation exposed to the wellbore; and measuring a difference between an injection flow rate and a return flow rate in the path;

reducing the expected pressure when the return flow rate is less than the injection flow rate; and performing a cementing operation at the reduced expected pressure.

12. The method of claim 11, wherein reducing the expected pressure comprises modifying properties of cementing slurry corresponding to the expected pressure.

13. The method of claim 11, wherein reducing the expected pressure comprises pumping return fluid during the cementing operation using a returns pump.

14. A method for cementing a wellbore, comprising:

injecting cement slurry into the wellbore having a tubular string disposed therein;

injecting chase fluid to pump the cement slurry into an annulus formed between the tubular string and the wellbore;

performing a mass balance between the chase fluid and fluid displaced from the wellbore;

controlling flow of fluid displaced from the wellbore using results of the mass balance;

after injecting the cement slurry, circulating indicator fluid across a wellhead of the wellbore; and comparing a flow rate of the indicator fluid into the wellhead to a flow rate of the indicator fluid from the wellhead.

15. The method of claim 14, wherein controlling flow of fluid displaced from the wellbore is performed by a programmable logic controller.

16. The method of claim 14, wherein performing a mass balance comprises:

measuring a flow rate of the chase fluid;

measuring a mass flow rate of the fluid displaced from the wellbore; and comparing the measured fluid rates.

17. The method of claim 16, wherein measuring a mass flow rate of the fluid displaced from the wellbore comprises:

diverting the displaced fluid from a bore of a pressure control assembly connected to the wellhead of the wellbore through a mass flow meter of the pressure control assembly.

18. The method of claim 17, wherein the wellbore is a subsea wellbore, and the mass flow meter is a subsea mass flow meter.

19. The method of claim 14, wherein injecting the cement slurry comprises injecting the cement slurry through a bore of the tubular string, and injecting the chase fluid comprises injecting the chase fluid through the bore of the tubular string.

20. The method of claim 14, further comprising monitoring curing of the cement slurry using one or more cement sensors on the tubular string.

* * * * *